US009884699B1

(12) United States Patent
Shamie et al.

(10) Patent No.: US 9,884,699 B1
(45) Date of Patent: Feb. 6, 2018

(54) NO TOOLS TOY BOX

(71) Applicant: Delta Enterprise Corp., New York, NY (US)

(72) Inventors: Louis Sam Shamie, New York, NY (US); Francisco J. Reyes, New York, NY (US)

(73) Assignee: Delta Enterprise Corp., New York, NY (US)

( * ) Notice: Subject to any disclaimer, the term of this patent is extended or adjusted under 35 U.S.C. 154(b) by 0 days.

(21) Appl. No.: 14/677,764

(22) Filed: Apr. 2, 2015

(51) Int. Cl.
*B65D 6/24* (2006.01)
*B65D 6/34* (2006.01)
*B65D 6/00* (2006.01)

(52) U.S. Cl.
CPC ..... *B65D 11/1873* (2013.01); *B65D 11/10* (2013.01); *B65D 11/22* (2013.01)

(58) Field of Classification Search
CPC ..... F16B 12/00; F16B 12/12; F16B 12/24; F16B 12/26; A47B 88/0014; B65D 11/1866; B65D 11/1873; B65D 11/22; B65D 11/20; B65D 11/26; B65D 9/34; B65D 9/12
USPC .... 220/4.28, 4.31, 4.32, 628, 629, 630, 636, 220/637, 638, 646, 647, 650
See application file for complete search history.

(56) References Cited

U.S. PATENT DOCUMENTS 1,209,027 A * 12/1916 Quade ..... B65D 9/12 217/12 R
4,238,044 A * 12/1980 Roddier ..... B65D 11/1873 220/4.28
5,593,058 A * 1/1997 Spencer ..... B65D 21/083 217/65
5,597,084 A * 1/1997 Parasin ..... B65D 11/1873 206/600
5,638,973 A * 6/1997 Dewey ..... B65D 11/1873 206/509
6,193,340 B1 * 2/2001 Schenker ..... A47B 47/0075 312/108
6,454,124 B1 * 9/2002 Edwards ..... E04F 21/02 220/4.32
7,413,111 B2 * 8/2008 Quaintance ..... B65D 5/0015 220/651
8,308,018 B2 * 11/2012 Kochanowski ..... B65D 88/005 217/12 R
8,925,751 B2 * 1/2015 Benz ..... F25D 23/04 220/4.32
2012/0286637 A1 * 11/2012 Fehre ..... A47B 88/20 312/330.1

* cited by examiner

*Primary Examiner* — Andrew Perreault
(74) *Attorney, Agent, or Firm* — Richard M. Goldberg

(57) ABSTRACT

A box includes first and second spaced apart side walls, and first and second ends walls connected to opposite ends of the side walls. Each side wall has an elongated slot at a lower end of an inner surface thereof, and each end wall has an elongated slot at a lower end of an inner surface thereof, with the elongated slots of the side walls and the end walls all being coplanar. First and second bottom boards are inserted in the elongated slots of the side walls to form a bottom wall of the box, and a closure member is inserted into a space between the first and second bottom boards to lock the first board in the elongated slots of the side walls and the first end wall and to lock the second board in the elongated slots of the side walls and the second end wall.

25 Claims, 34 Drawing Sheets

NO TOOLS TOY BOX

BACKGROUND OF THE INVENTION

The present invention relates generally to sturdy boxes for holding various items, including, for example, toys, and more particularly, is directed to a box that can be easily assembled without the use of any tools, while retaining structural integrity.

The use of toy boxes, made from wood, plastic, etc., for holding children's toys are well known. These toy boxes are generally assembled using screws or bolts in order to provide structural integrity. However, such assembly is burdensome and time consuming. Further, over time, the screws and bolts can loosen, thereby reducing the structural integrity and possibly providing a hazard for the child.

It is also known to assemble different furniture pieces without the use of tools by using dovetail sliding joints and the like. However, the construction and assembly also tends to be rather difficult.

SUMMARY OF THE INVENTION

Accordingly, it is an object of the present invention to provide a toy box that overcomes the aforementioned problems.

It is another object of the present invention to provide a toy box that can be easily assembled without the use of any tools, while retaining structural integrity.

It is still another object of the present invention to provide a toy box that is easy and economical to use and manufacture.

In accordance with an aspect of the present invention, a box includes first and second spaced apart side walls, and first and second ends walls connected to opposite ends of the side walls. Each of the side walls has an elongated slot at a lower end of an inner surface thereof. At least one flooring member is inserted in the elongated slots of the side walls to form a bottom wall of the box. A closure member is inserted into a space adjacent the at least one flooring member to lock the at least one flooring member in the elongated slots of the side walls and the first and second end walls.

At least one of the end walls has an elongated slot at a lower end of an inner surface thereof, with the elongated slots of the side walls and the at least one end wall being coplanar with each other, and wherein the at least one flooring member is locked in the elongated slots of the side walls and the at least one end wall when the closure member is inserted into the space adjacent the at least one flooring member.

Preferably, each of the end walls has an elongated slot at a lower end of an inner surface thereof, with the elongated slots of the side walls and the end walls being coplanar with each other, and wherein the at least one flooring member is locked in the elongated slots of the side walls and the end walls when the closure member is inserted into the space adjacent the at least one flooring member.

In one embodiment, the at least one flooring member includes first and second flooring members, each inserted in the elongated slots of the side walls to form the bottom wall of the box, and the closure member is inserted between the first and second flooring members. In a modification thereof, the at least one flooring member includes a single flooring member, and the closure member is inserted between an end of the single flooring member and one end wall.

The first and second side walls are in parallel, spaced apart relation to each other and the first and second end walls are in parallel, spaced apart relation to each other.

Each end wall has a vertically oriented narrow recess at opposite sides thereof, with one end of each recess being open, and each side wall has a connecting plate at opposite sides thereof, with each connecting plate removably locking within one narrow recess. Each narrow recess includes at least one side wall securing rib, and each connecting plate is L-shaped and engages with the at least one side wall securing rib to releasably lock each side wall to a respective end wall.

Each of the end walls has an elongated slot at a lower end of an inner surface thereof, with the elongated slots of the side walls and the end walls being coplanar with each other, the elongated slots of the end walls open at opposite ends thereof into the narrow recesses at opposite sides thereof. Further, the elongated slots of the side walls open at opposite ends thereof into the connecting plates at opposite sides thereof.

There are also hand openings in upper ends of the end walls, and/or upper ends of the side walls.

Each side wall has a capturing recess for holding one end of the closure member in a position adjacent the at least one flooring member. At least one side wall has a ramp positioned below the respective capturing recess for aiding in inserting a respective end of the closure member in the respective capturing recess.

The closure member includes a first section that lies against an underside of the at least one flooring member.

In accordance with another aspect of the present invention, a method of assembling a box, includes a first step of assembling a first end of a first side wall having an elongated slot at a lower end of an inner surface thereof, with a first end of a first end wall at a lower end of an inner surface thereof; a second step of assembling a first end of a second side wall having an elongated slot at a lower end of an inner surface thereof, with a second end of the first end wall such that the first and second side walls are in spaced apart relation; a third step of sliding at least one flooring member into the elongated slots of the first and second side walls from second, opposite ends of the first and second side walls; a fourth step of assembling the second end of the first side wall with a first end of a second end wall; a fifth step of assembling the second end of the second side wall with a second end of the second end wall; and a sixth step of inserting a closure member into a space adjacent the at least one flooring member to lock the at least one flooring member in the elongated slots of the side walls.

At least one of the end walls has an elongated slot at a lower end of an inner surface thereof, with the elongated slots of the side walls and the at least one end wall being coplanar with each other, and further comprising the step of locking the at least one flooring member in the elongated slots of the side walls and the at least one end wall when the closure member is inserted into the space adjacent the at least one flooring member.

Preferably, each of the end walls has an elongated slot at a lower end of an inner surface thereof, with the elongated slots of the side walls and the end walls being coplanar with each other, and further comprising the step of locking the at least one flooring member in the elongated slots of the side walls and the end walls when the closure member is inserted into the space adjacent the at least one flooring member.

In one embodiment, the at least one flooring member includes first and second flooring members, each inserted in the elongated slots of the side walls to form the bottom wall of the box, and the sixth step includes the step of inserting the closure member between the first and second flooring members.

In a modification, the at least one flooring member includes a single flooring member, and the sixth step includes the step of inserting the closure member between an end of the single flooring member and one end wall.

The first through fourth assembling steps results in the first and second side walls being in parallel, spaced apart relation to each other and the first and second end walls being in parallel, spaced apart relation to each other.

Each end wall has a vertically oriented narrow recess at opposite sides thereof, with one end of each recess being open, and each side wall has a connecting plate at opposite sides thereof, and each of the first through fourth assembling steps includes the step of removably locking each connecting plate within a respective narrow recess. Each narrow recess includes at least one side wall securing rib, and each connecting plate is L-shaped, and the step of removably locking includes the step of engaging each L-shaped connecting plate with a respective side wall securing rib to releasably lock each side wall to a respective end wall.

Each of the end walls has an elongated slot at a lower end of an inner surface thereof, with the elongated slots of the side walls and the end walls being coplanar with each other, and the elongated slots of the end walls open at opposite ends thereof into the narrow recesses at opposite sides thereof, and wherein the at least one flooring member also extends outwardly of the elongated slots into the narrow recesses. Also, the elongated slots of the side walls open at opposite ends thereof into the connecting plates at opposite sides thereof.

Each side wall has a capturing recess, and wherein the sixth step of inserting a closure member includes the step of inserting opposite ends of the closure member into the capturing recesses for holding the closure member in a position between the at least one flooring member. Further, at least one side wall has a ramp positioned below a respective capturing recess, and the sixth step of inserting a closure member includes the step of sliding one end of the closure member up the ramp for aiding in inserting the respective end of the closure member in the respective capturing recess. Also, the sixth step of inserting a closure member includes the step of inserting the closure member so that a first section thereof lies against an underside of the at least one flooring member.

The above and other objects, features and advantages of the invention will become readily apparent from the following detailed description thereof which is to be read in connection with the accompanying drawings.

DETAILED DESCRIPTION

Figure 1:
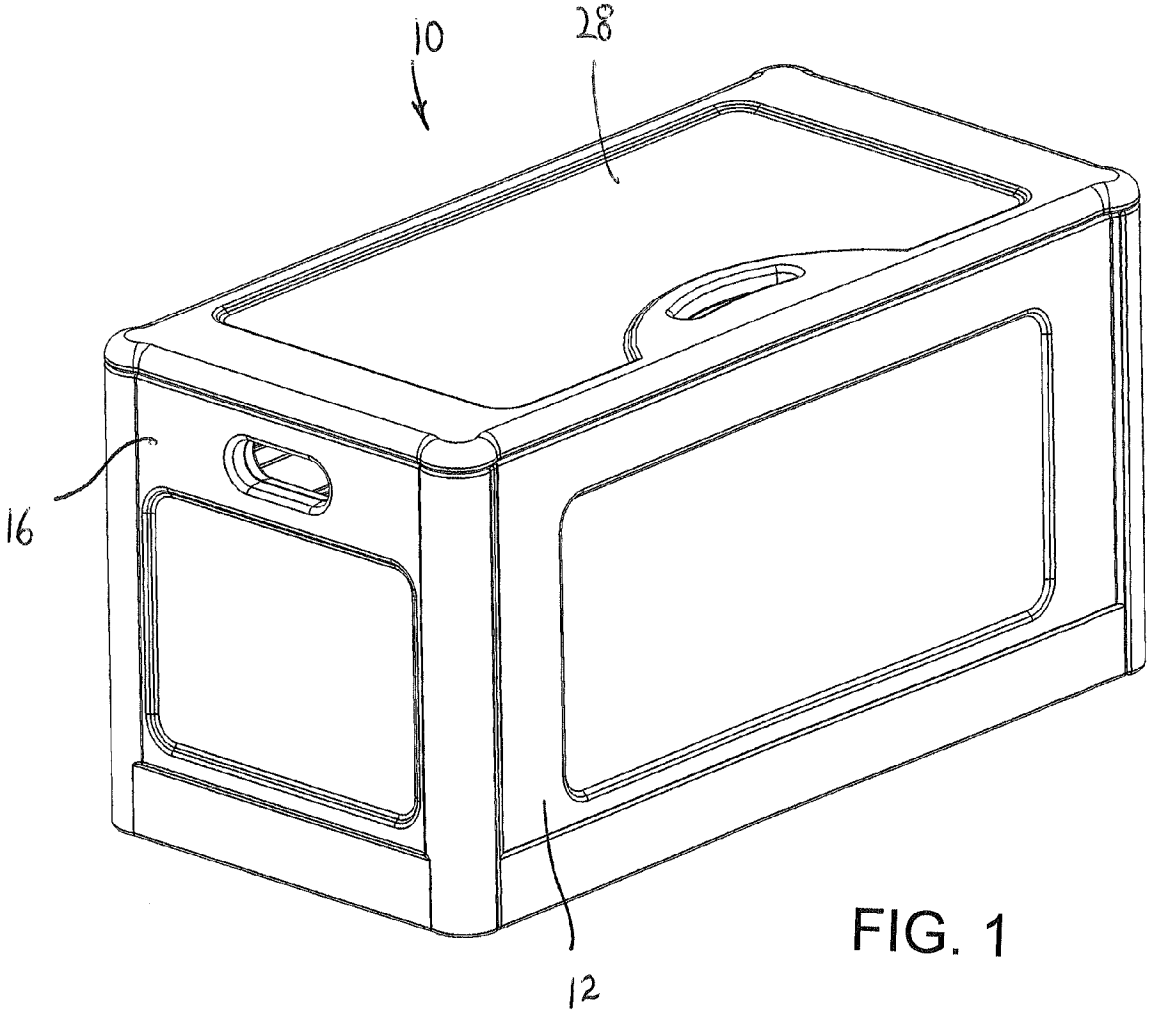
FIG. 1 is a top perspective view of a toy box according to the present invention.

Referring to the drawings in detail, a toy box 10 according to a first embodiment of the present invention has a generally rectangular parallelepiped construction, although the present invention is not limited thereby.

Figure 2:
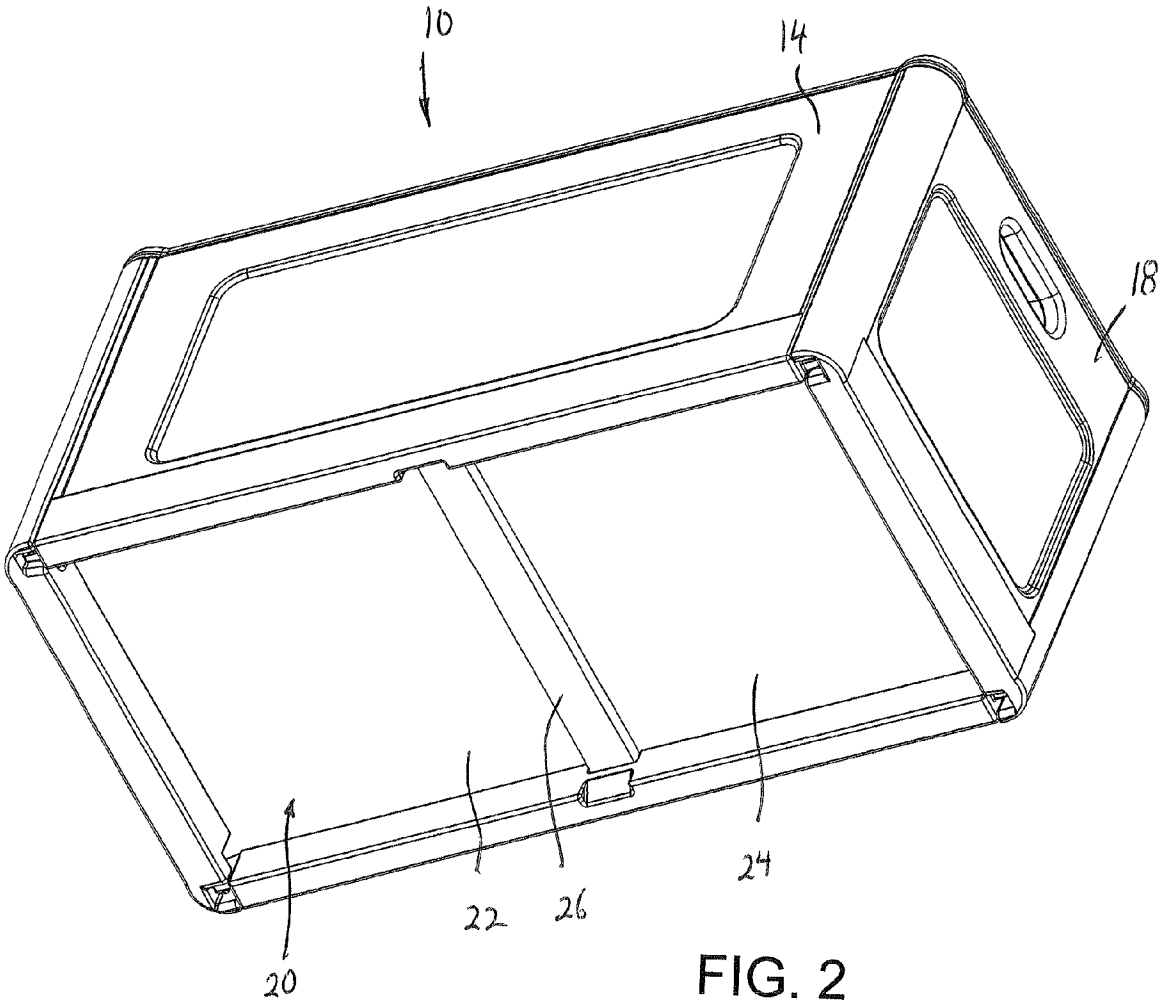
FIG. 2 is a bottom perspective view of the toy box.
Figure 3:
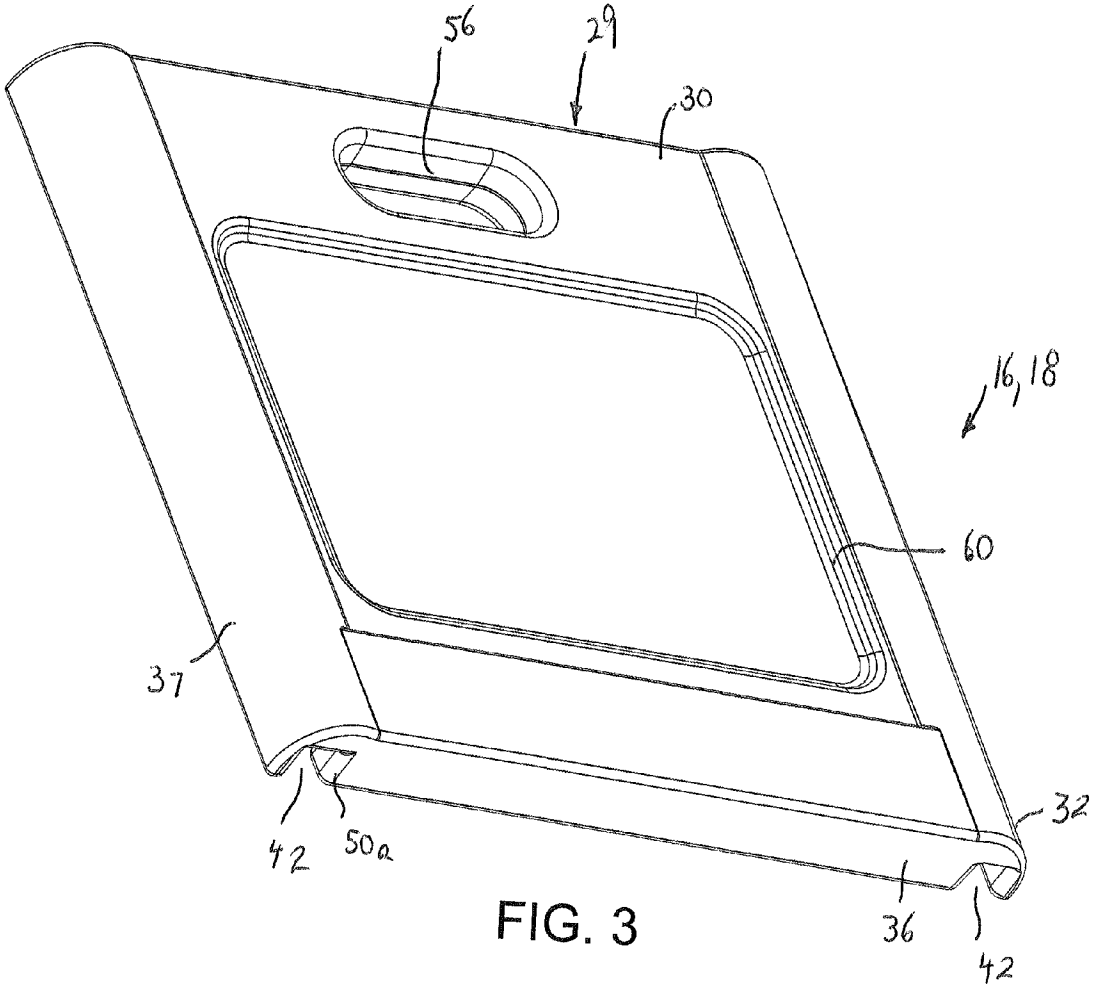
FIG. 3 is a bottom, outer perspective view of one end panel.
Figure 4:
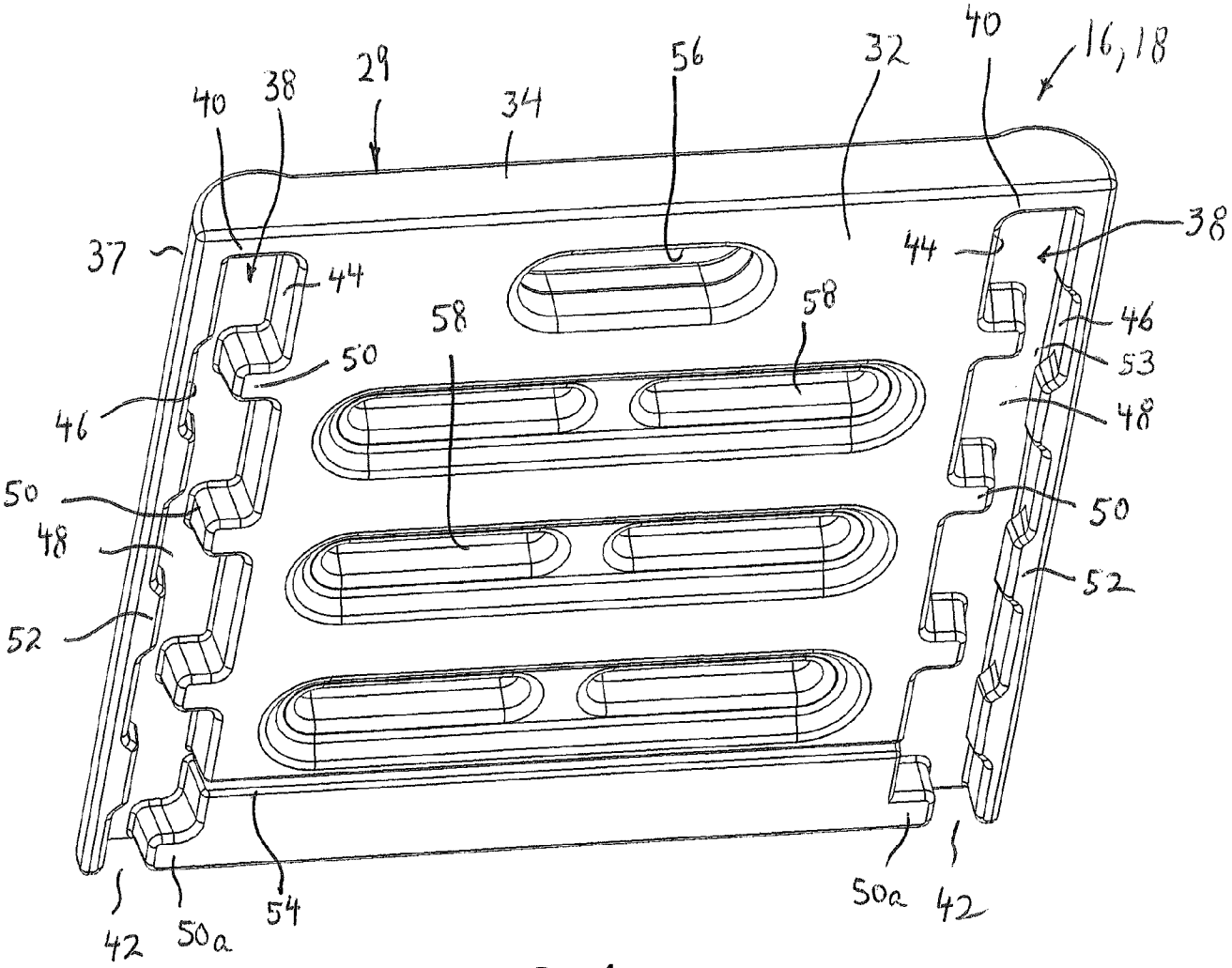
FIG. 4 is a top, inner perspective view of the end panel.
Figure 5:
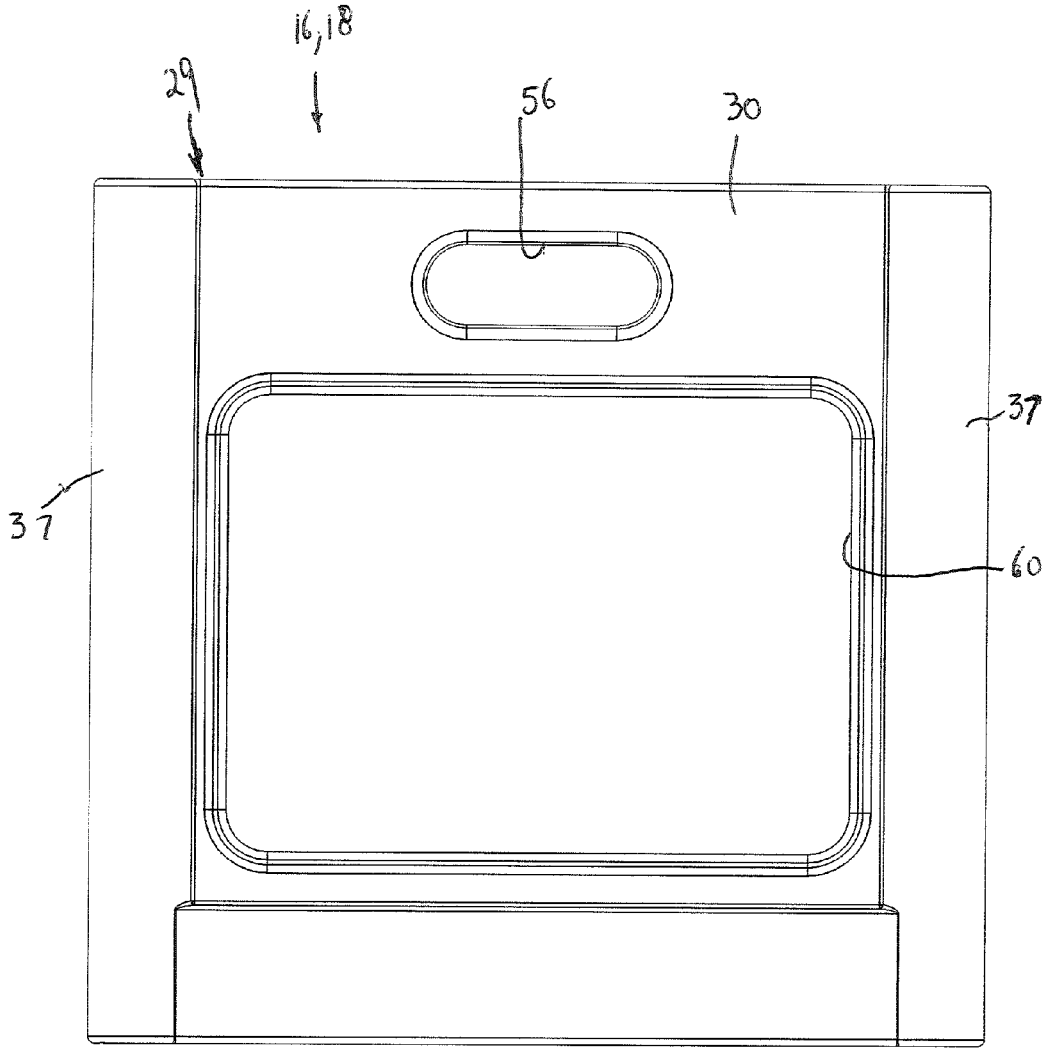
FIG. 5 is an outer elevational view of the end panel.
Figure 6:
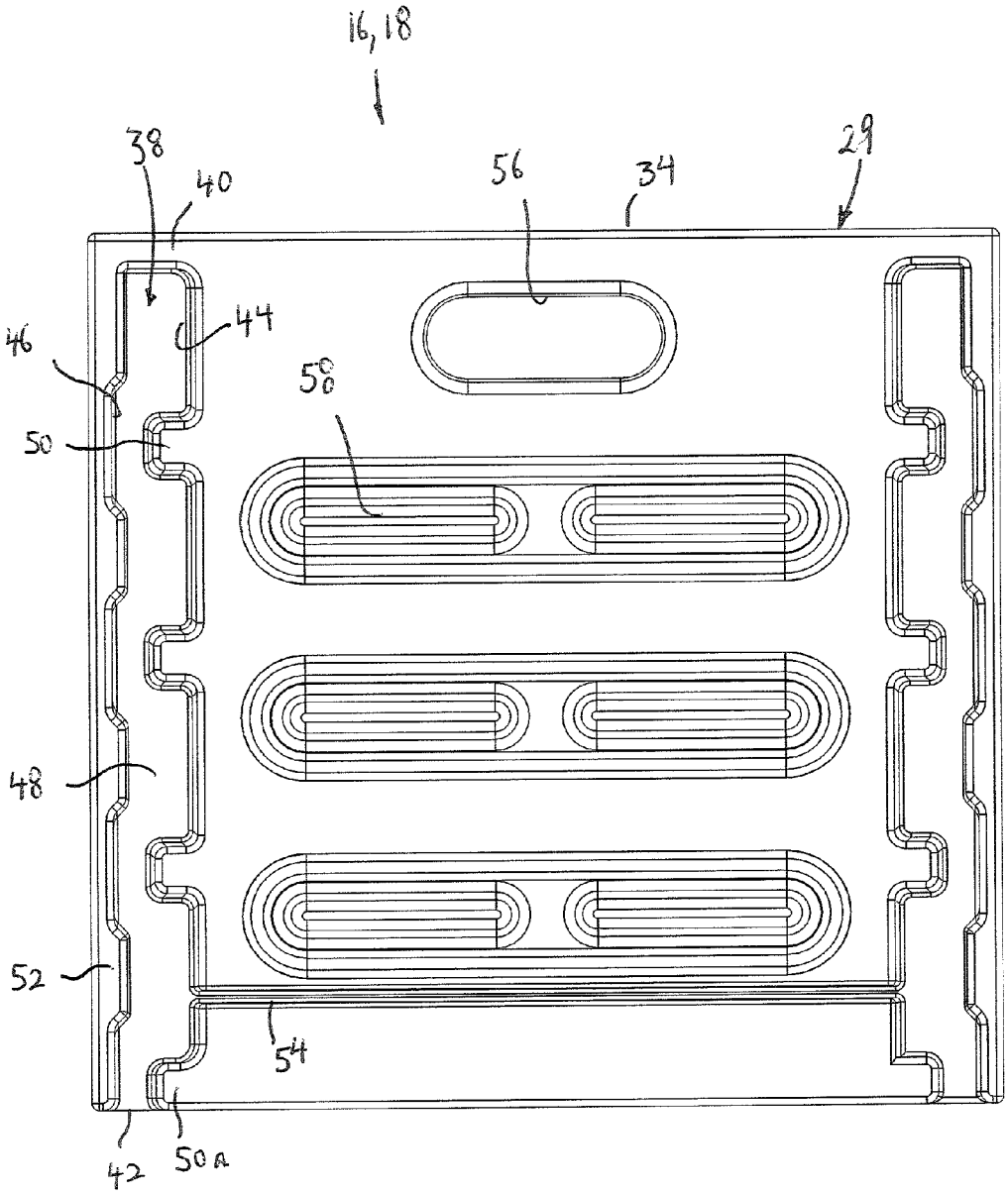
FIG. 6 is an inner elevational view of the end panel.

Specifically, as shown generally in FIGS. 1 and 2, toy box 10 includes first and second side walls 12 and 14, which are connected together at ends thereof by first and second end walls 16 and 18. A bottom wall 20 is formed by first and second generally square shaped bottom boards 22 and 24

Figure 14:
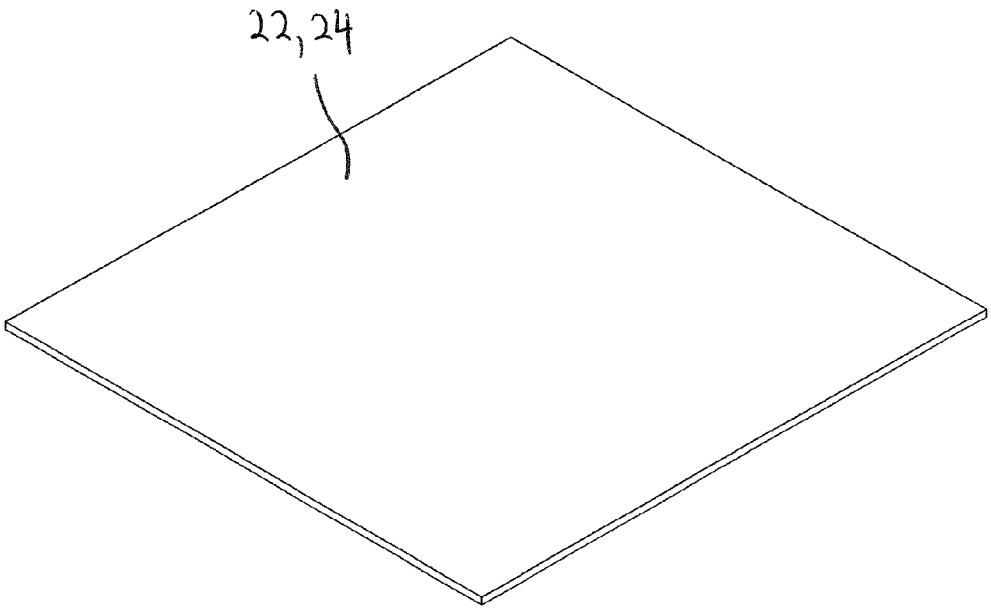
FIG. 14 is a perspective view of one bottom board.

(FIG. 14), although any flooring member can be used in place of boards 22 and 24. For example, the flooring member need not be planar as with boards 22 and 24, but can have different contours. A closure rod 26 is provided to secure and lock first and second bottom boards 22 and 24 with first and second side walls 12 and 14 and with first and second end walls 16 and 18. Finally, a removable cover 28 is provided to cover the upper open end of toy box 10. Preferably, first and second side walls 12 and 14, first and second end walls 16 and 18 and removable cover 28 are made from a rigid plastic material, and first and second bottom boards 22 and 24 and closure rod 26 are made from a medium density fiberboard (MDF), although the present invention is not limited thereto.

As shown best in FIGS. 3-7, each end wall 16, 18 includes a solid generally square parallelepiped shaped end panel 29, with a generally square outer surface 30, a generally square inner surface 32, a top surface 34, a bottom surface 36, and rounded side surfaces 37. A vertically oriented, generally rectangular, narrow recess 38 is provided at each end of each end wall 16, 18, extending through inner surface 32 from a position through bottom surface 36 and up to a position slightly spaced from top surface 34, that is, closed by a closure wall 40 at its upper end and having an inlet opening 42 at bottom surface 36. Each recess 38 is thereby defined by an inner vertical wall 44, a parallel, spaced apart outer vertical wall 46, upper closure wall 40 which connects together vertical walls 44 and 46, and a bottom wall 48 which contains outer surface 30 on the opposite side thereof.

Reinforcing and guiding ribs 50 extend partially into recess 38 from inner vertical wall 44 in parallel, spaced apart relation to each other. Each reinforcing and guiding rib 50 extends the full height of inner vertical wall 44 and is also connected with bottom wall 48. Although four reinforcing and guiding ribs 50 are shown, the present invention is not limited thereby. Preferably, a lowermost reinforcing and guiding rib 50*a* extends in line with bottom surface 36. Furthermore, guiding ribs 50 can be eliminated, and need not be provided to define each recess 38.

Figure 7:
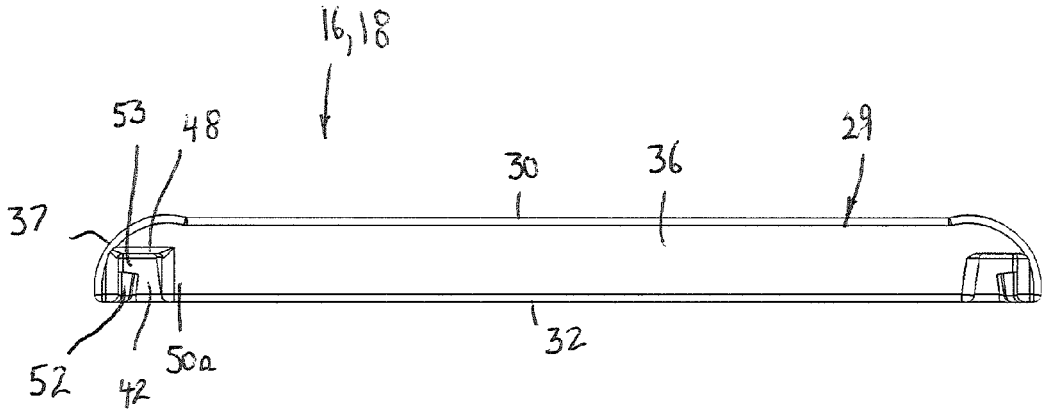
FIG. 7 is a bottom plan view of the end panel.
Figure 8:
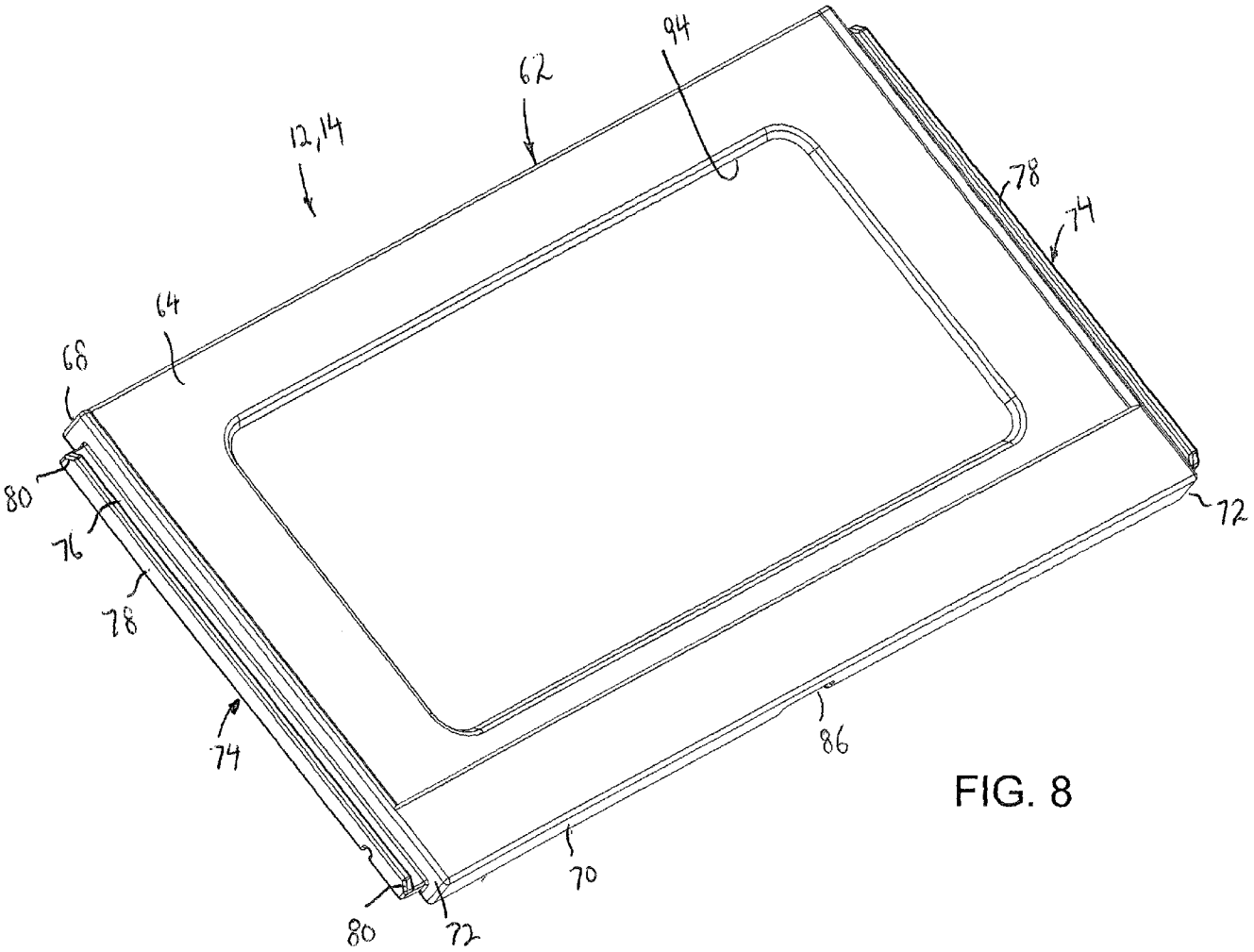
FIG. 8 is an outer, bottom perspective view of one side panel.
Figure 9:
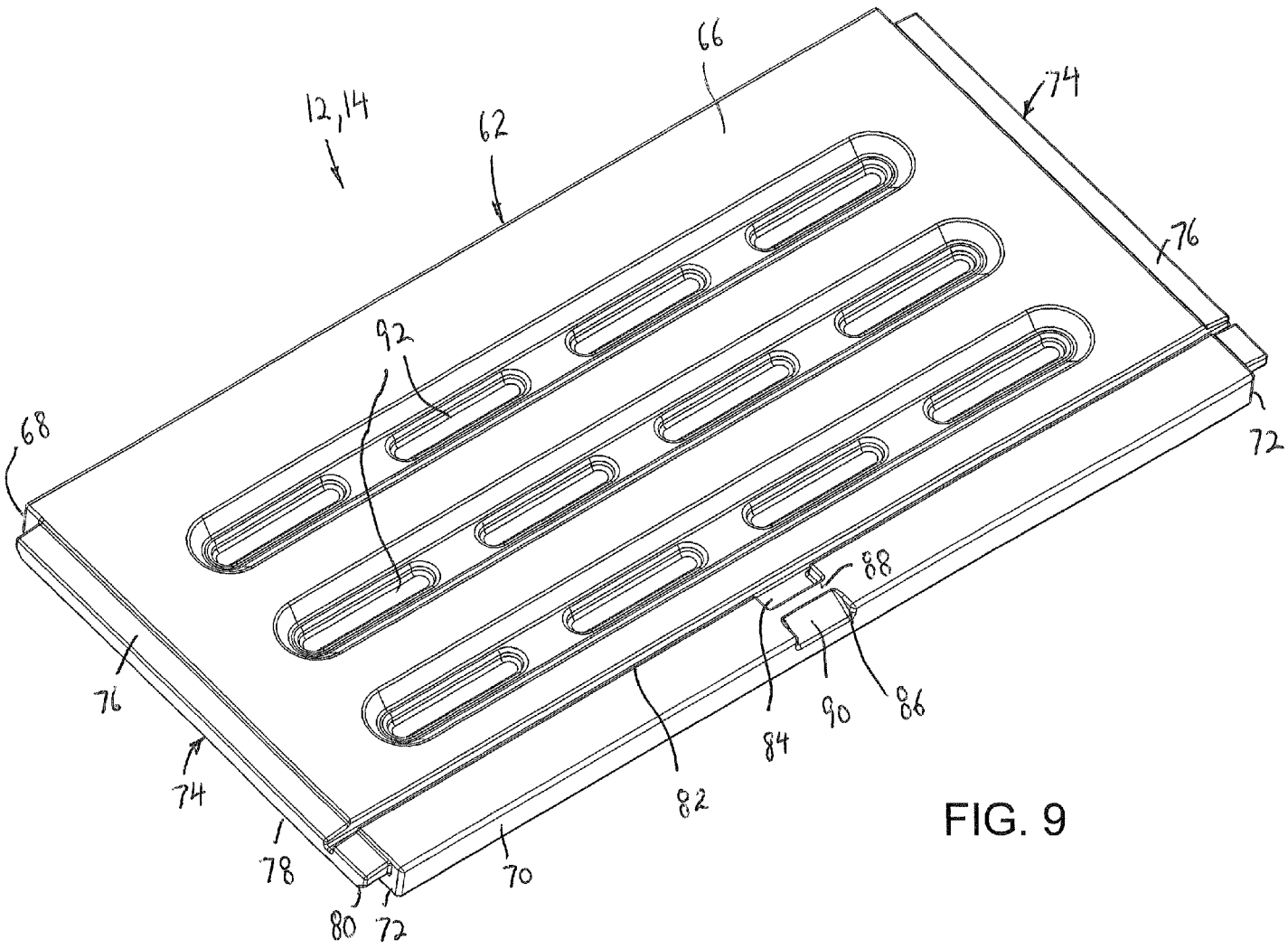
FIG. 9 is an inner, bottom perspective view of the side panel.
Figure 10:
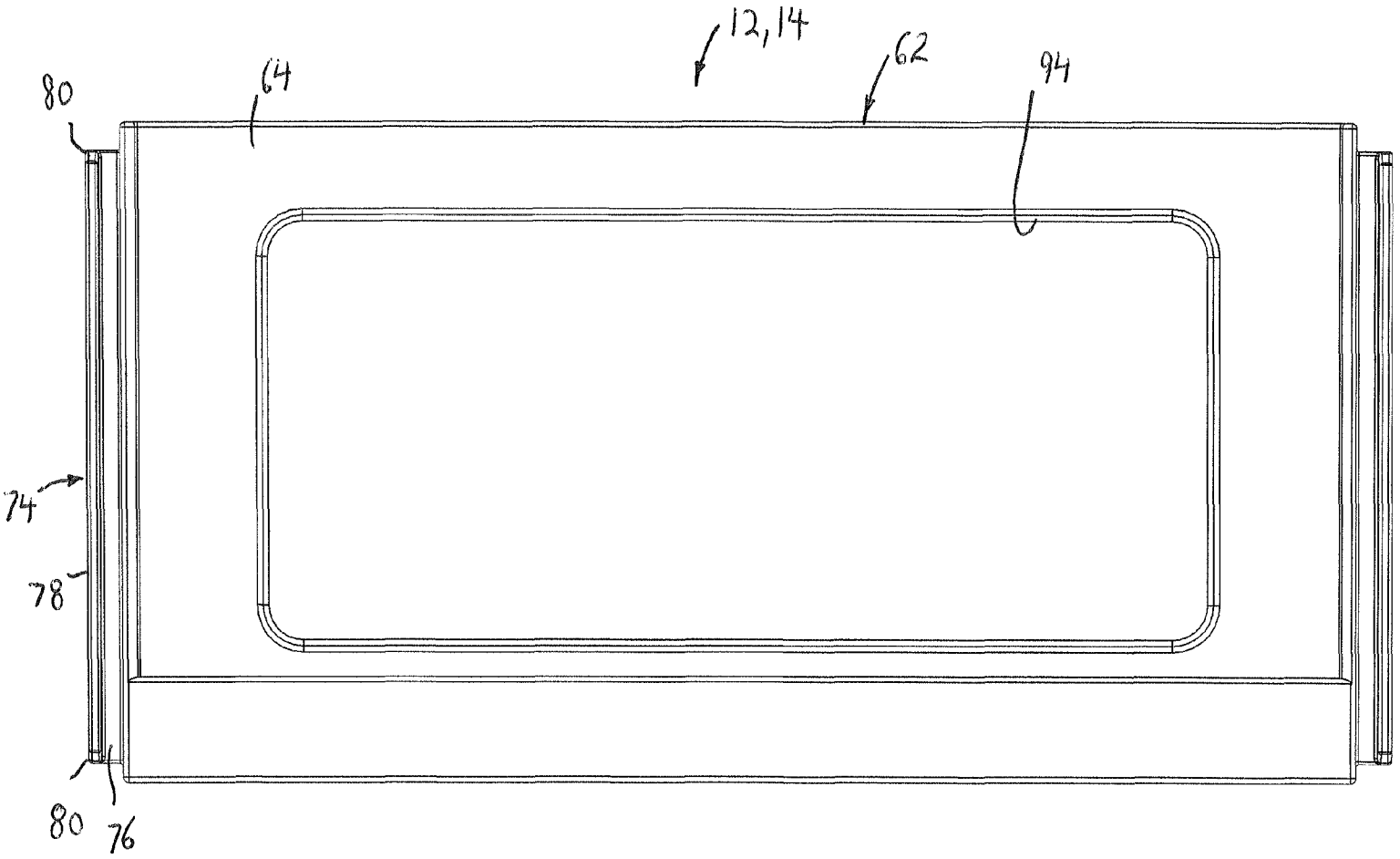
FIG. 10 is an outer elevational view of the side panel.
Figure 11:
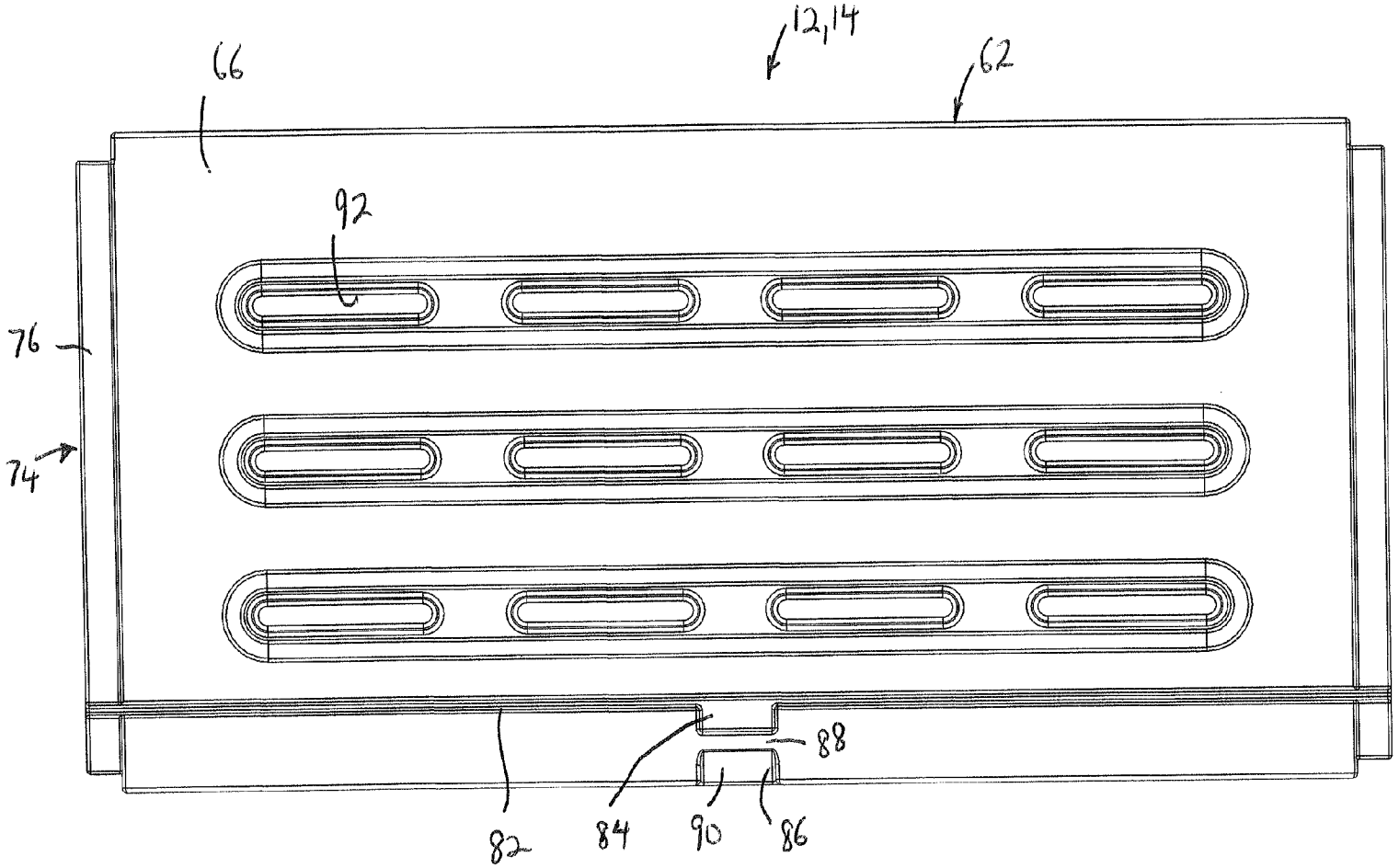
FIG. 11 is an inner elevational view of the side panel.
Figure 13:
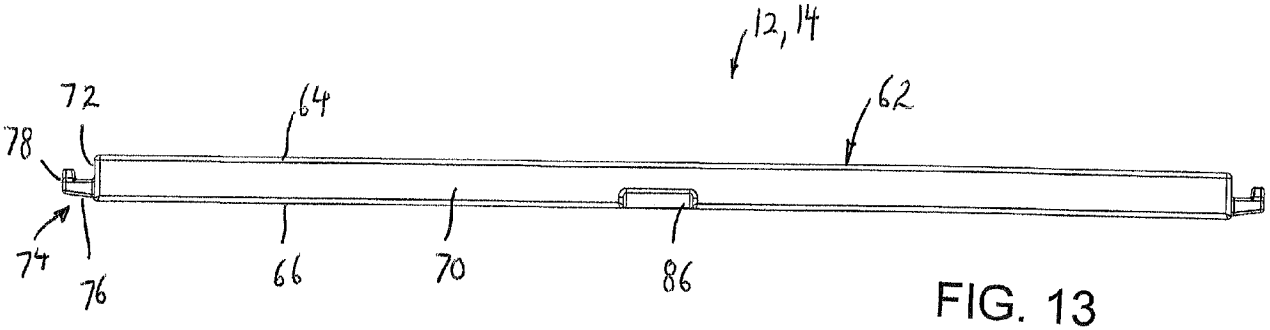
FIG. 13 is a bottom plan view of the side panel.
Figure 12:
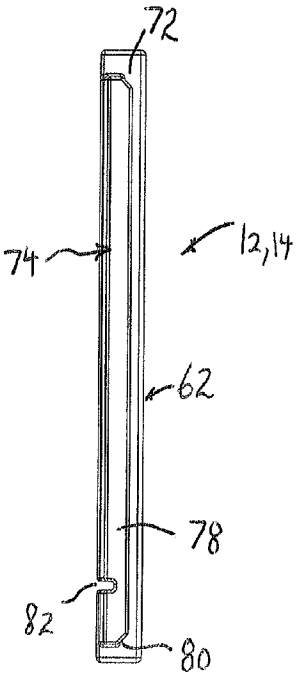
FIG. 12 is an end elevational view of the side panel.

In addition, side wall securing ribs 52 extend from outer vertical wall 46 in spaced apart relation to each other, preferably at positions between reinforcing and guiding ribs 50. However, unlike reinforcing and guiding ribs 50, side wall securing ribs 52 are spaced from bottom wall 48 of recess 38 to provide a capturing space 53 therebetween, as best shown in FIG. 7, the purpose for which will be understood from the discussion which follows. In addition, side wall securing ribs 52 can also be eliminated.

An elongated board capturing slot 54 extends horizontally through inner surface 32 and exits at opposite ends thereof through inner vertical walls 44 of opposite recesses 38. Further, a hand opening 56 extends entirely through ends walls 16, 18 centrally at an upper end thereof. It will be appreciated, however, that hand openings can alternatively extend entirely through side walls 12, 14 centrally at upper ends thereof.

In order to increase the strength and rigidity of end walls 16, 18, a plurality of horizontally oriented recesses 58 are provided in inner surface 32 and extend partially through end walls 16, 18, at positions between elongated board capturing slot 54 and hand opening 56. In order to increase the strength and rigidity, a rectangular shallow recess 60 is provided in outer surface 30.

As shown best in FIGS. 8-13, each side wall 12, 14 includes a solid generally rectangular parallelepiped shaped side panel 62, with a generally rectangular outer surface 64, a generally rectangular inner surface 66, a top surface 68, a bottom surface 70, and opposite side surfaces 72.

An L-shaped connecting plate 74 extends outwardly from each side surface 72, and specifically, includes a first elongated plate 76 thereof that extends outwardly from each side surface 72 and a second elongated plate 78 that extends at a right angle from the free edge of first elongated plate 76 in a direction toward the outside of each side panel 62. First elongated plate 72 is spaced slightly from top surface 68 and bottom surface 70. In addition, the opposite ends of second elongated plate 78 include beveled edges 80.

An elongated board capturing slot 82 extends horizontally entirely through inner surface 66 and exits at opposite ends, continuing through first elongated plates 76 on opposite sides thereof.

A rod capturing recess 84 is formed centrally in inner surface 66 just below elongated board capturing slot 82 and in open communication therewith. A rod entry recess 86 is formed in inner surface 66, open at bottom surface 70 and extending toward rod capturing recess 84 but spaced therefrom by a land 88. Rod entry recess 86 includes a ramp surface 90 that decreases in depth from bottom surface 70 toward the opposite end thereof.

In order to increase the strength and rigidity of side walls 12, 14, a plurality of horizontally oriented recesses 92 are provided in inner surface 66 and extend partially through side walls 12, 14, at positions between rod capturing recess 84 and top surface 68. In order to increase the strength and rigidity, a rectangular shallow recess 94 is provided in outer surface 64.

Figure 15:
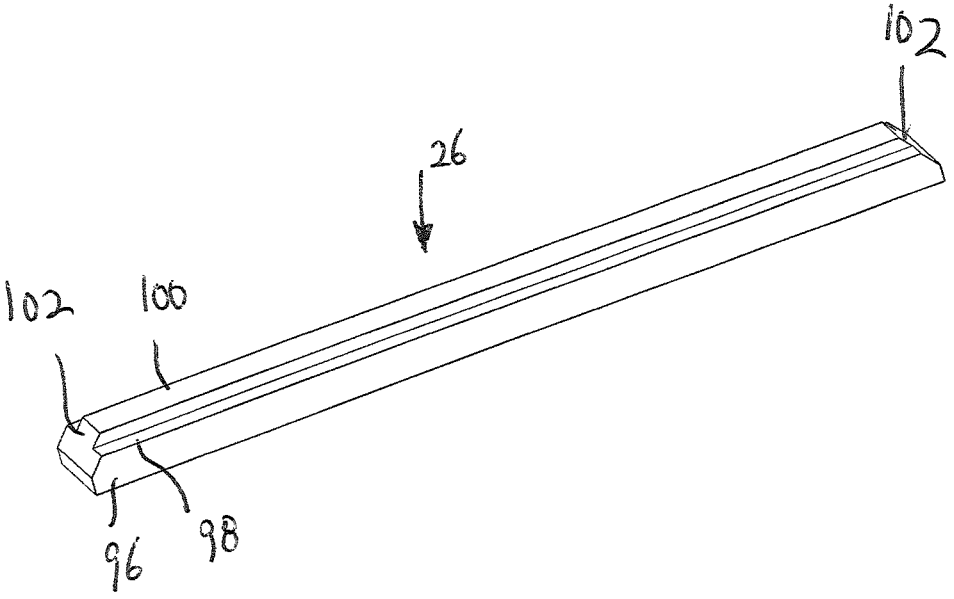
FIG. 15 is a perspective view of the closure rod.
Figure 16:
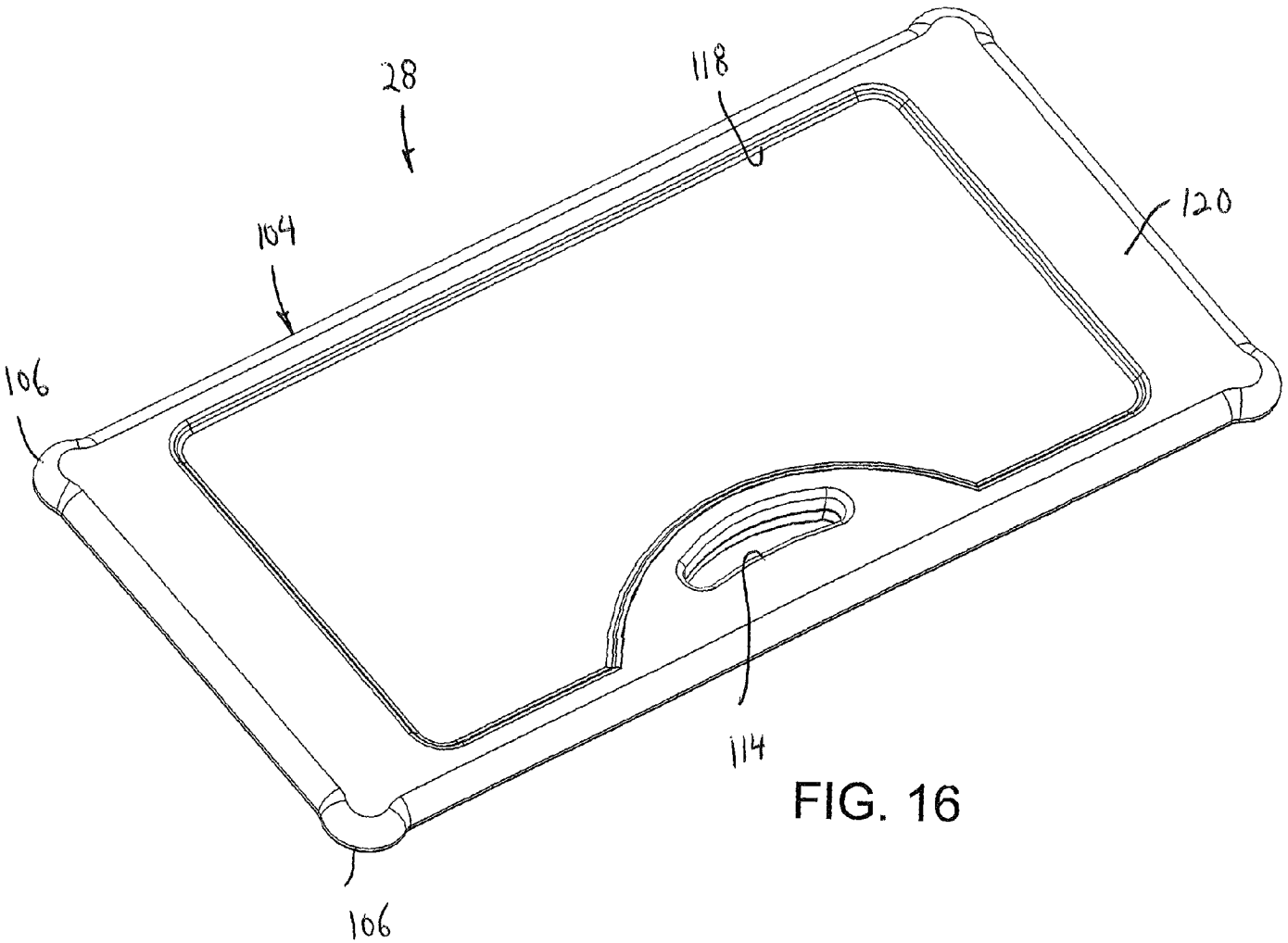
FIG. 16 is an upper perspective view of the removable cover.
Figure 17:
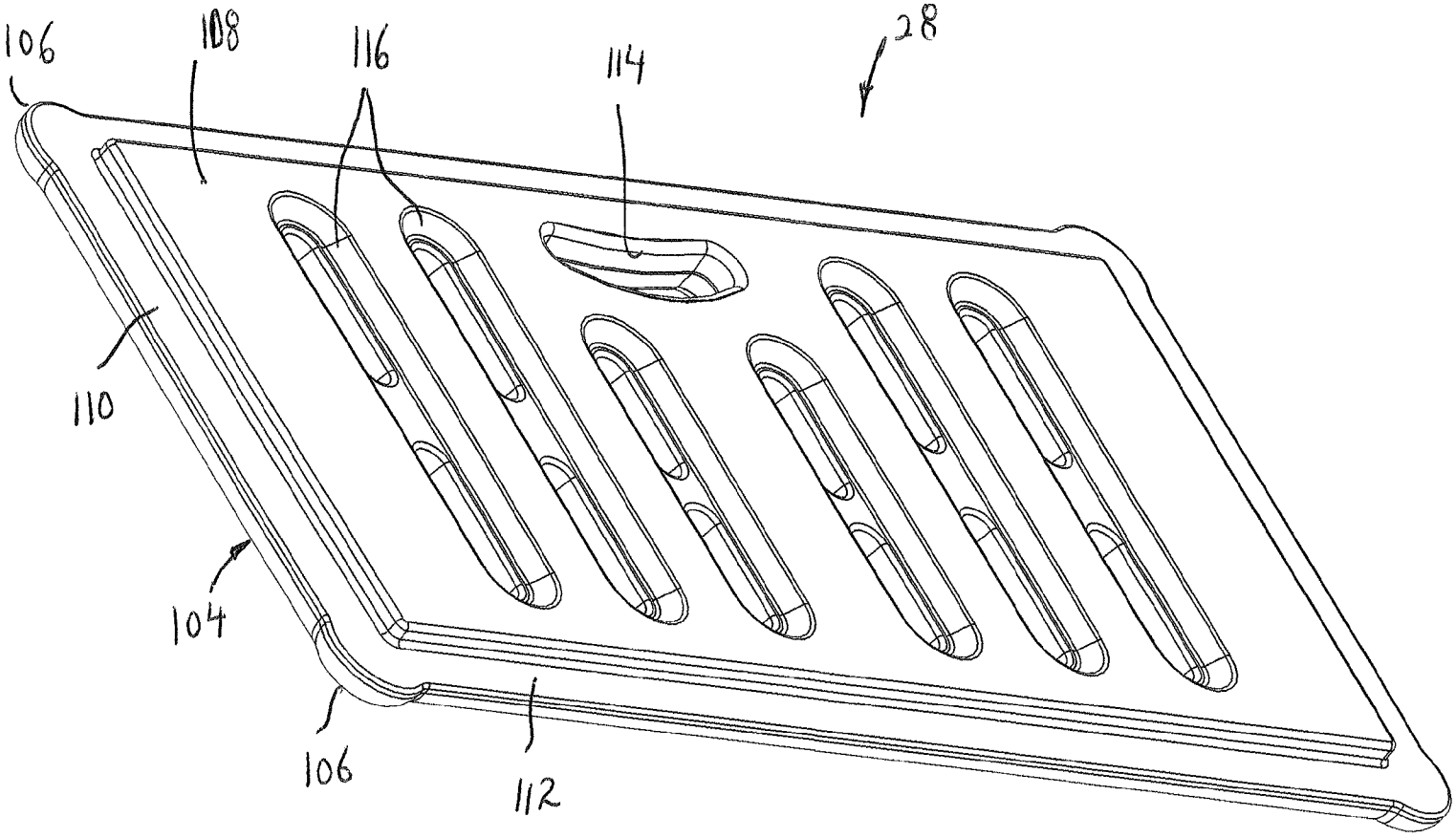
FIG. 17 is a lower perspective view of the removable cover.
Figure 18:
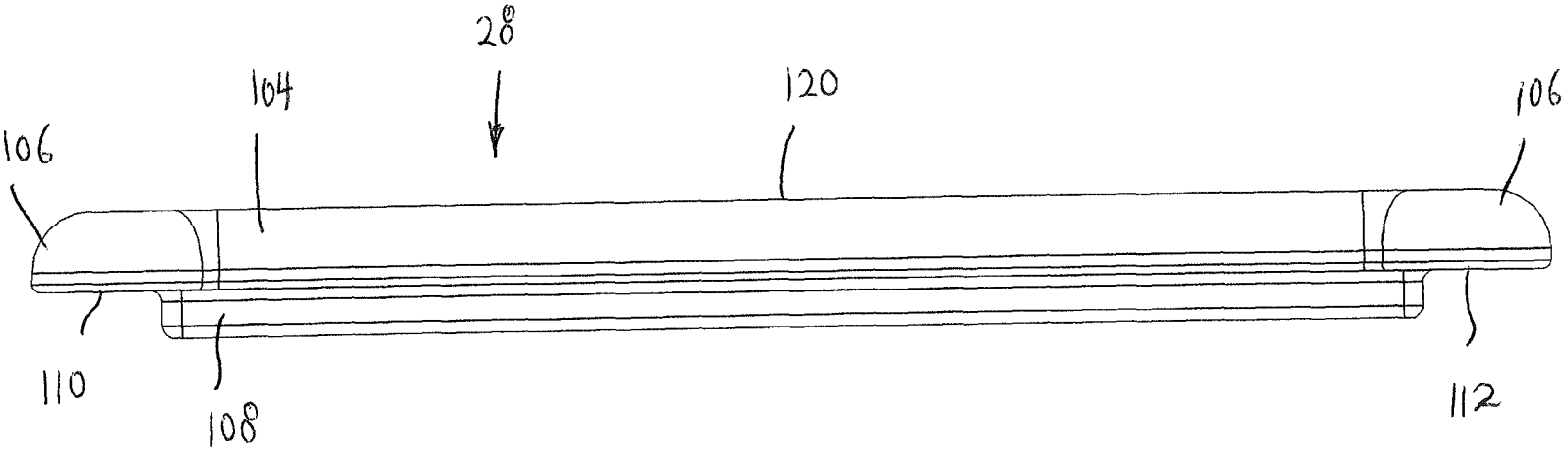
FIG. 18 is a side elevational view of the removable cover.

As shown in FIG. 15, closure rod 26 is formed by a generally elongated, rectangular parallelepiped bar 96 having an upper surface 98 with an insertion bar 100 extending upwardly therealong. Further, opposite ends of elongated bar 96 and insertion bar 100 have beveled ends 102.

Lastly, as shown in FIGS. 16-20, removable cover 28 includes a generally rectangular panel 104 having rounded corners 106. A rectangular raised portion 108 of lesser outer dimensions than panel 104, extends downwardly from the lower surface 110 of panel 104, thereby defining a shoulder 112 at the lower surface 110 in surrounding relation to raised portion 108. A hand opening 114 extends entirely through panel 104 and raised portion 108 at a center position of cover 28 adjacent an elongated side edge thereof. A plurality of horizontally oriented recesses 116 are provided in raised portion 108 and extend partially into panel 104, and a rectangular shallow recess 118 is provided in an outer surface 120 of panel 104, in order to increase the strength and rigidity thereof.

Referring now to FIGS. 19-24, a description of the assembly of toy box 10 will now be described.

Figure 19:
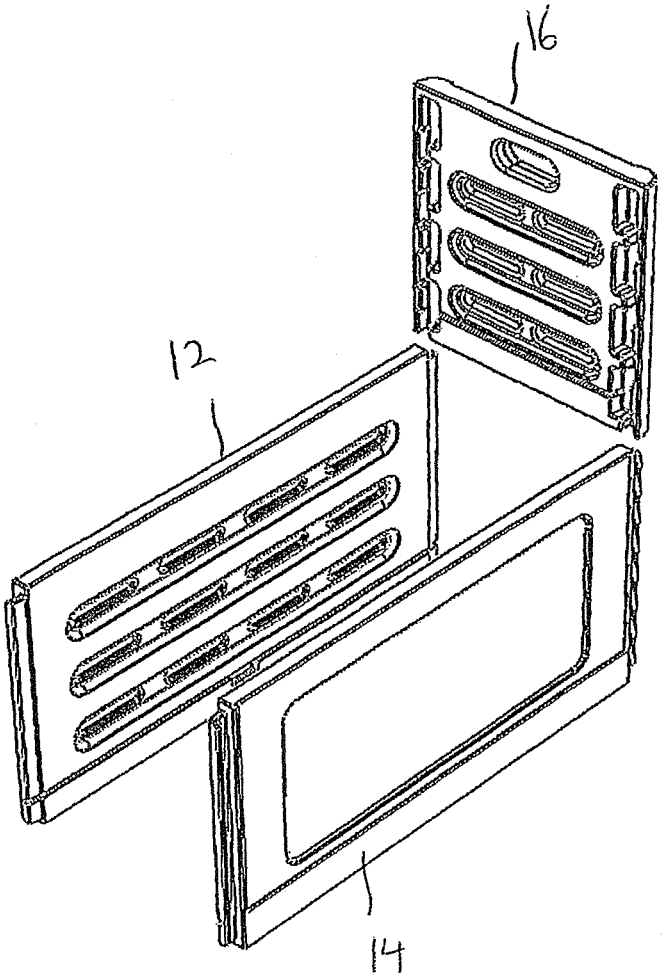
FIG. 19 is a perspective view showing a first assembly step of the side walls to one end wall.

As shown in FIG. 19, in a first assembly step, side walls 12, 14 are connected to first end wall 16. In doing so, L-shaped connecting plates 74 at one end of side walls 12, 14 are inserted through inlet openings 42 into vertically oriented narrow recesses 38 of first end wall 16. During this insertion, second elongated plates 78 thereof are inserted in capturing spaces 53 between bottom wall 48 of recesses 38 and side wall securing ribs 52, until the upper ends of L-shaped connecting plates 74 abut against closure walls 40. In such position, elongated board capturing slots 54 and 82 are in alignment in a common plane.

Figure 20:
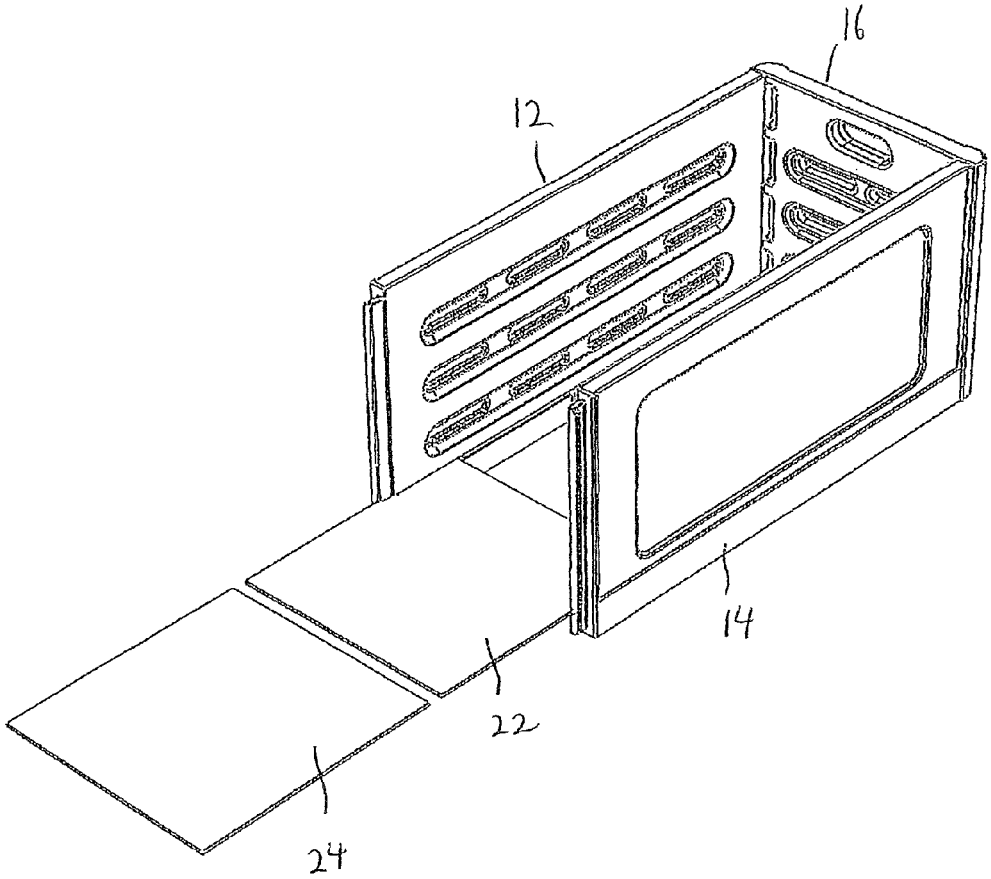
FIG. 20 is a perspective view showing a second assembly step of the bottom boards to the side walls.

As shown in FIG. 20, in a second assembly step, bottom boards 22 and 24 are then slid into elongated board capturing slots 82 of side walls 12, 14, and bottom board 22 can even be slid into elongated board capturing slot 54 of first end wall 16 at this time.

Figure 21:
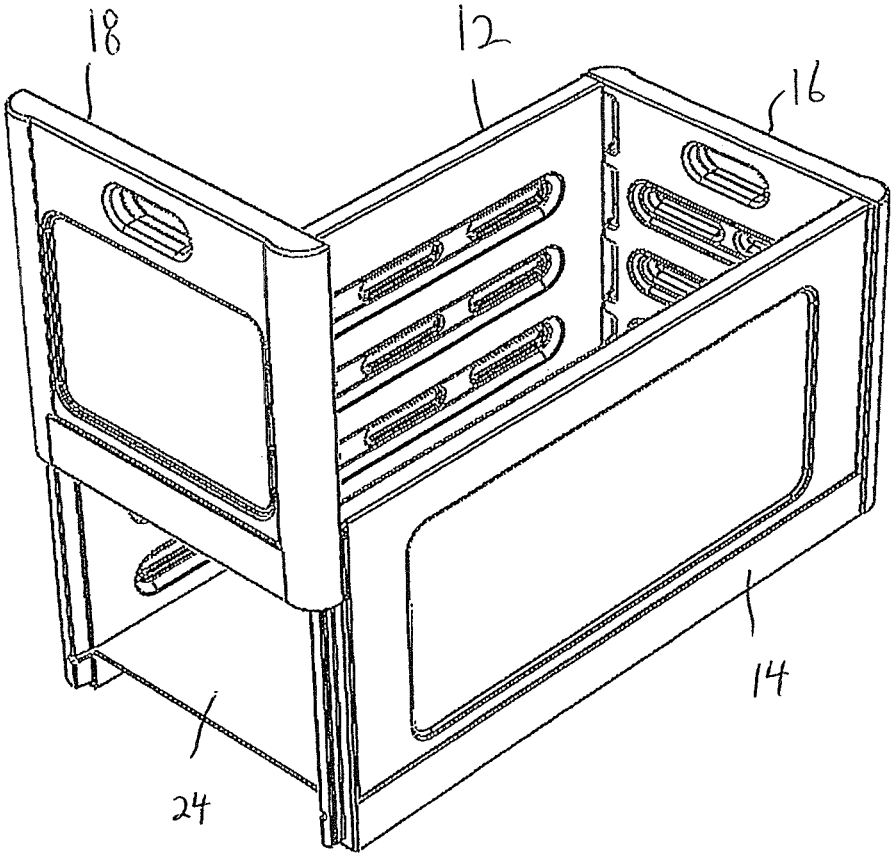
FIG. 21 is a perspective view showing a third assembly step of the other end wall to the side walls.

Thereafter, as shown in FIG. 21, in a third assembly step, second end wall 18 is connected to the opposite ends of side walls 12, 14 in the same manner as in the first step of FIG. 19. Specifically, L-shaped connecting plates 74 at the opposite ends of side walls 12, 14 are inserted through inlet openings 42 into vertically oriented narrow recesses 38 of second end wall 18. During this insertion, second elongated plates 78 thereof are inserted in capturing spaces 53 between bottom wall 48 of recesses 38 and side wall securing ribs 52, until the upper ends of L-shaped connecting plates 74 abut against closure walls 40. In such position, elongated board capturing slots 54 and 82 at the opposite side of box 10 are also in alignment in a common plane.

Figure 22:
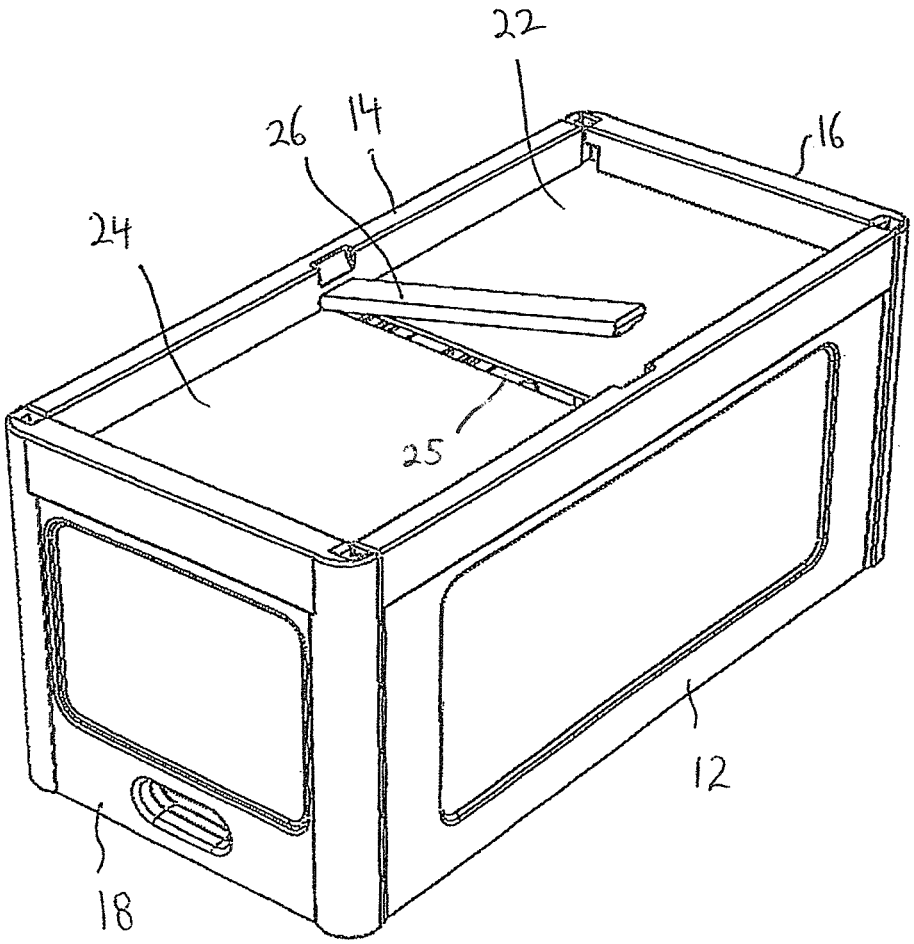
FIG. 22 is a perspective view of the assembly of FIG. 21 rotated so the bottom is facing up and showing a fourth assembly step of the closure rod.
Figure 23:
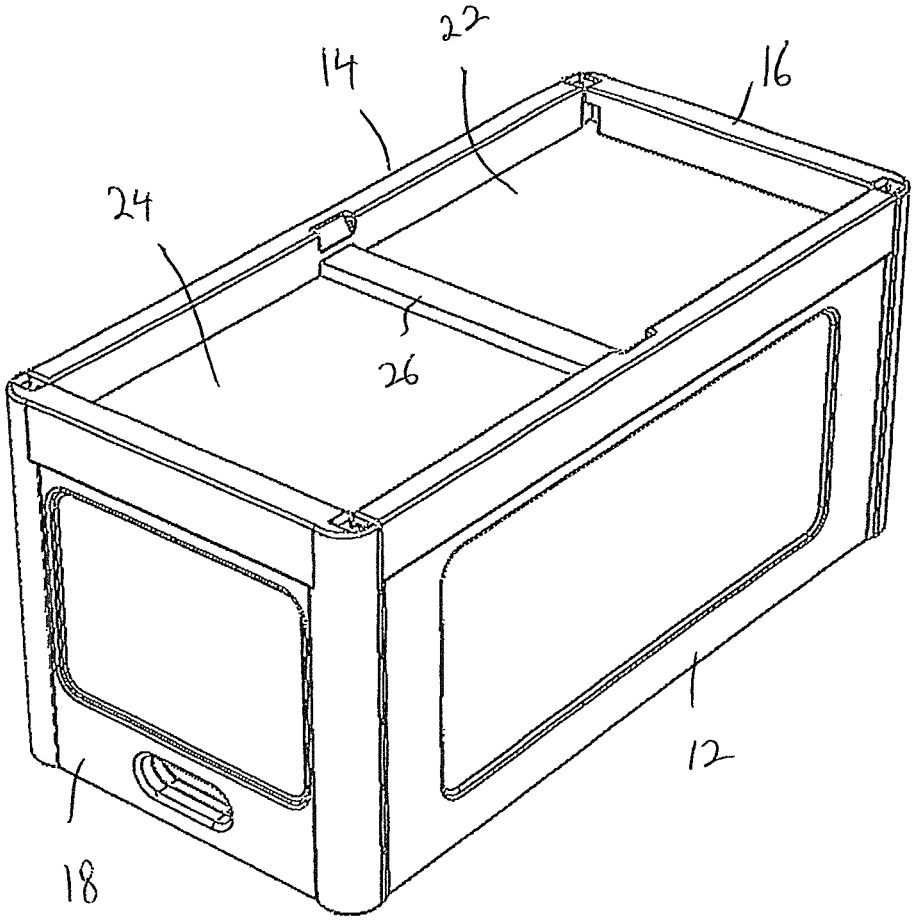
FIG. 23 is a perspective view similar to FIG. 22, with the closure rod fully inserted.

As shown in FIGS. 22 and 23, in a fourth assembly step, the assembly of FIG. 21 is rotated so that the bottom is facing up. Then, insertion bar 100 of closure rod 26 is force fit in the space 25 between bottom boards 22 and 24. For this purpose as shown in FIG. 22, one end of closure rod 26 is inserted into one rod capturing recess 84, and the opposite end of closure rod 26 rides up ramp surface 90 at the opposite side of toy box 10, and is then force fit over land 88 until it snaps into place into the other rod capturing recess 84, thereby locking closure rod 24 is place. This results in moving of first bottom board 22 so that it is inserted into elongated board capturing slot 54 of first end wall 16 and moving second bottom board 24 in the opposite direction so that it is inserted into elongated board capturing slot 54 of second end wall 18, thereby locking bottom boards 22, 24 in position, with upper surface 98 of closure rod 26 on opposite sides of insertion bar 100, lying flush against the lower surfaces of bottom boards 22 and 24.

Figure 24:
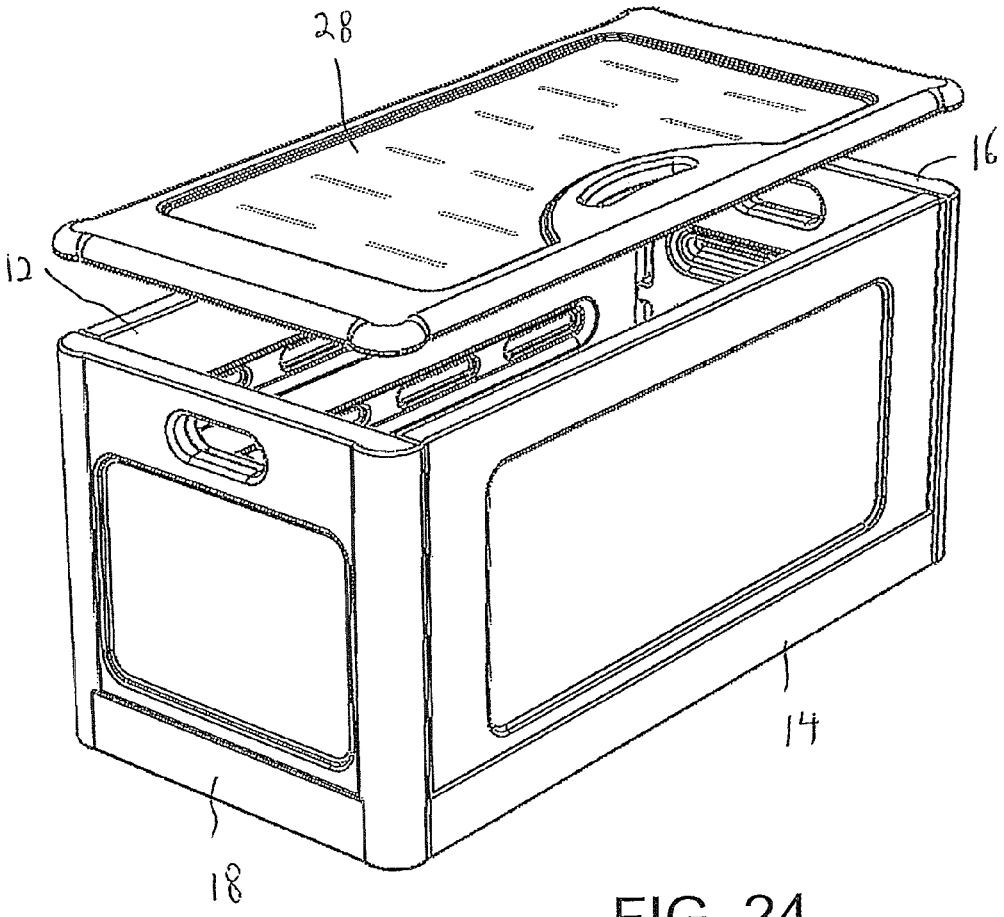
FIG. 24 is a perspective view of the assembly of FIG. 23, rotated back so that the bottom is facing down, and showing a fifth assembly step of inserting the cover thereon.

Thereafter, as shown in FIG. 24, the assembly of FIG. 23 is rotated back so that the bottom is facing down. In a fifth assembly step, removable cover 28 is then inserted in covering relation to the upper open end so that raised portion 108 sits within the upper ends of side walls 12, 14 and end walls 16, 18, and shoulder 112 rests on top of side walls 12, 14 and end walls 16, 18.

It will be appreciated that boards 22 and 24 can be replaced with a single board 223 or single equivalent flooring member, as shown in the modified embodiment toy box 210 of FIGS. 25-35, in which like elements from the first embodiment of toy box 10 are denoted by the same numerals.

Specifically, the differences are that, in addition to single board 223, rod capturing recess 84 is formed at one end of first and second side walls 12 and 14, in inner surface 66 just below elongated board capturing slot 82 and in open communication therewith. Further, rod entry recess 86 is formed in inner surface 66, open at bottom surface 70 and extending toward rod capturing recess 84 but spaced therefrom by a land 88. Rod entry recess 86 includes a ramp surface 90 that decreases in depth from bottom surface 70 toward the opposite end thereof.

A description of the assembly of toy box 210 will now be described.

Figure 25:
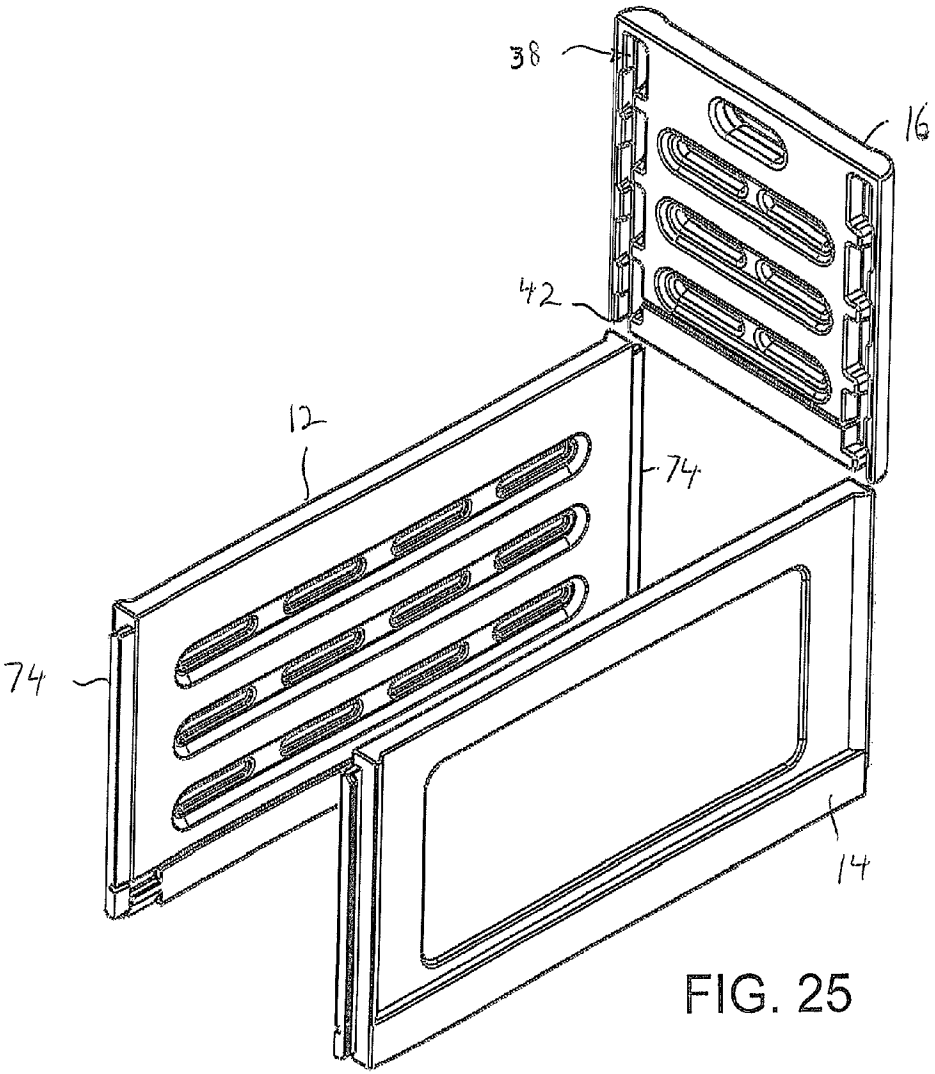
FIG. 25 is a perspective view showing a first assembly step of the side walls to one end wall in the modified embodiment.

As shown in FIG. 25, in a first assembly step, side walls 12, 14 are connected to first end wall 16. In doing so, L-shaped connecting plates 74 at one end of side walls 12, 14 are inserted through inlet openings 42 into vertically oriented narrow recesses 38 of first end wall 16. During this insertion, second elongated plates 78 thereof are inserted in capturing spaces 53 between bottom wall 48 of recesses 38 and side wall securing ribs 52, until the upper ends of L-shaped connecting plates 74 abut against closure walls 40. In such position, elongated board capturing slots 54 and 82 are in alignment in a common plane.

Figure 26:
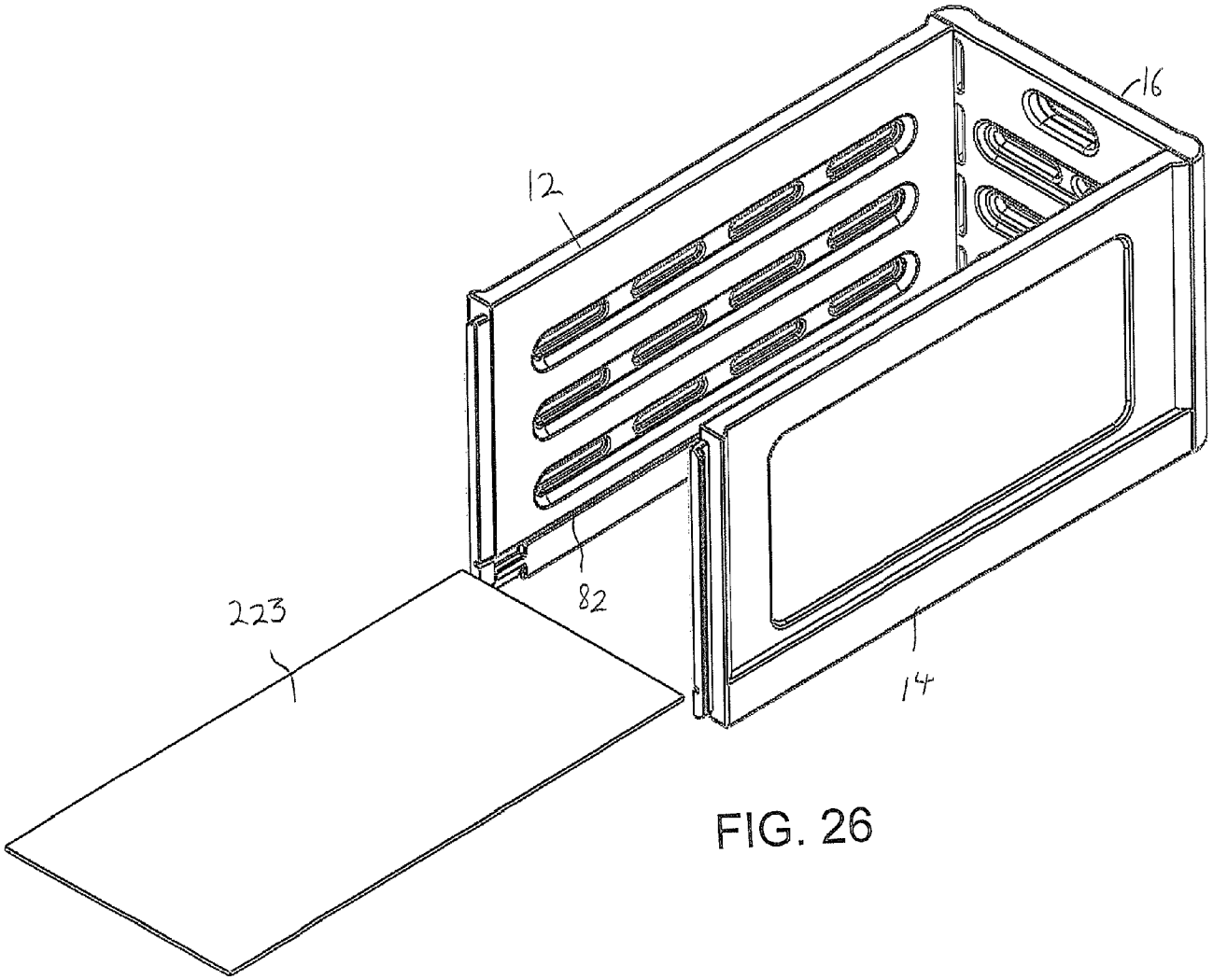
FIG. 26 is a perspective view showing a second assembly step of the bottom board to the side walls in the modified embodiment.
Figure 27:
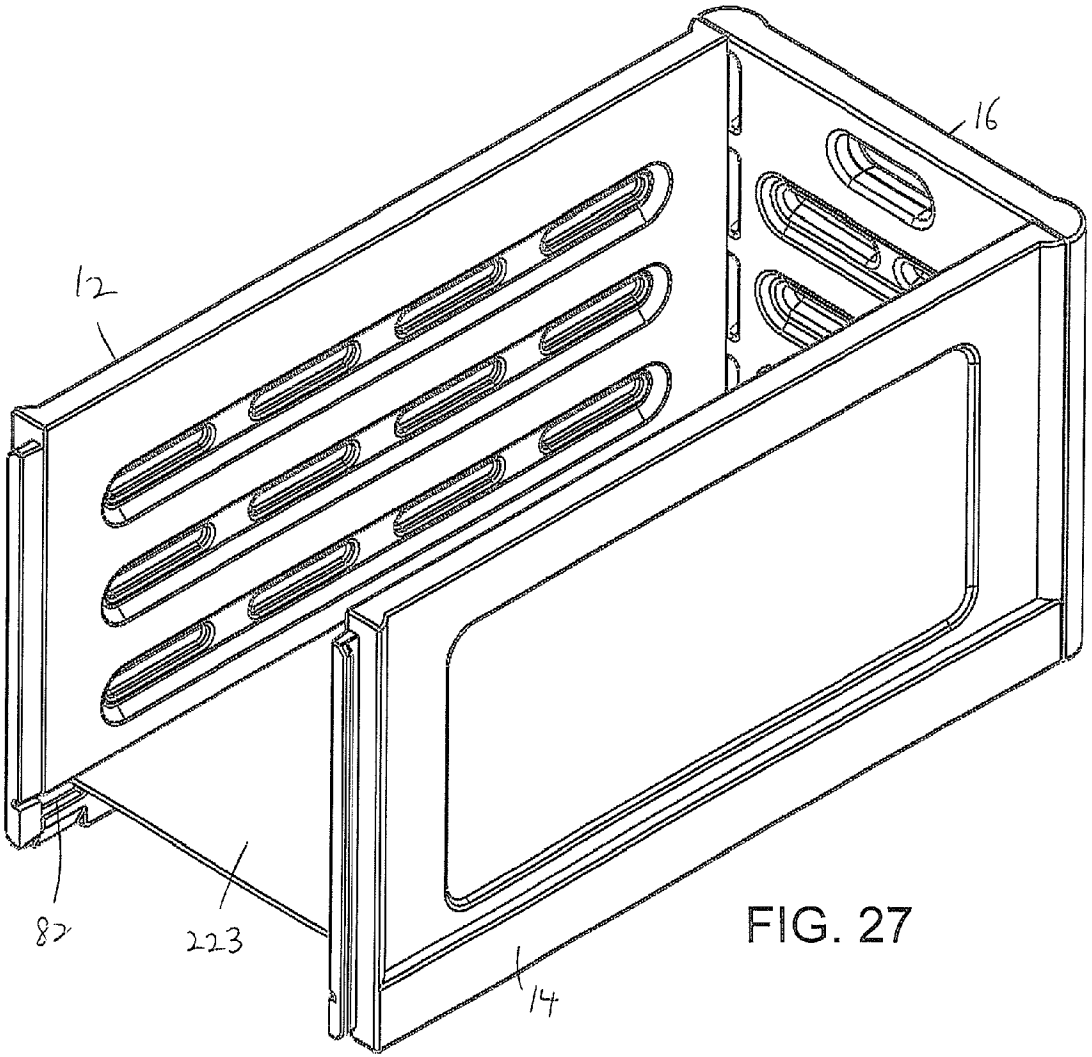
FIG. 27 is a perspective view showing completion of the second assembly step of the bottom board to the side walls in the modified embodiment.

As shown in FIGS. 26 and 27, in a second assembly step, single board 223 is then slid into elongated board capturing slots 82 of side walls 12, 14 and board capturing slot 54 of first end wall 16, with the opposite end of single board 223 spaced from the opposite free ends of side walls 12, 14.

Figure 28:
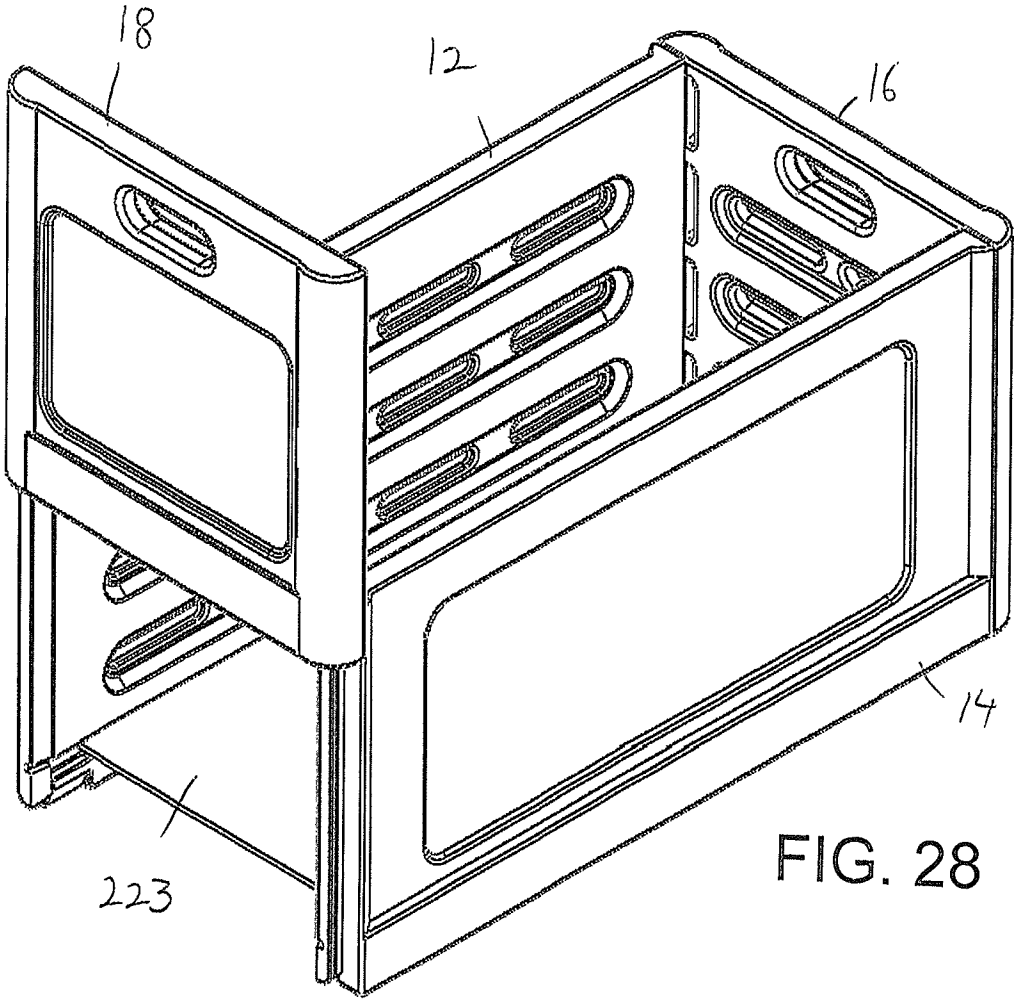
FIG. 28 is a perspective view showing a third assembly step of the other end wall to the side walls in the modified embodiment.
Figure 29:
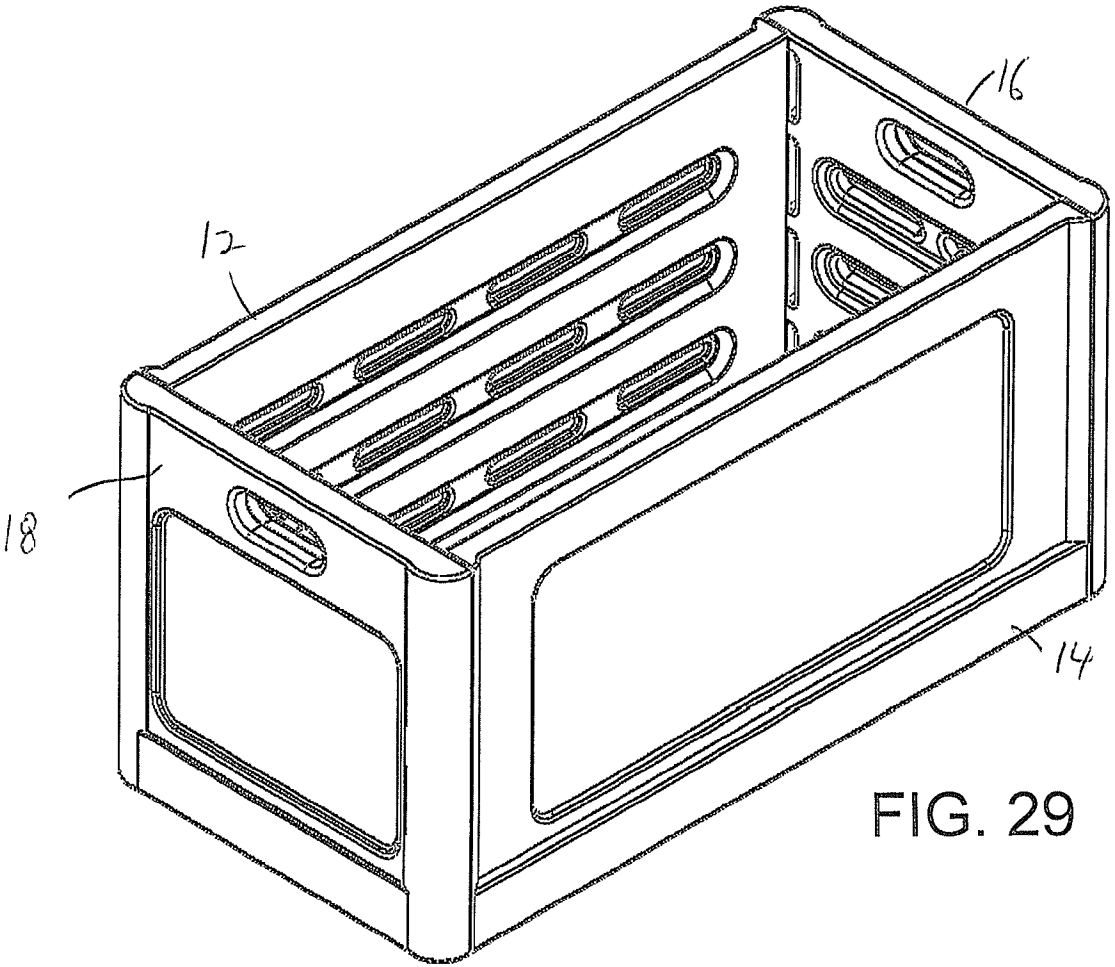
FIG. 29 is a perspective view showing completion of the third assembly step of the other end wall to the side walls in the modified embodiment.

Thereafter, as shown in FIGS. 28 and 29, in a third assembly step, second end wall 18 is connected to the opposite ends of side walls 12, 14 in the same manner as in the first step of FIG. 25. Specifically, L-shaped connecting plates 74 at the opposite ends of side walls 12, 14 are inserted through inlet openings 42 into vertically oriented narrow recesses 38 of second end wall 18. During this insertion, second elongated plates 78 thereof are inserted in capturing spaces 53 between bottom wall 48 of recesses 38 and side wall securing ribs 52, until the upper ends of L-shaped connecting plates 74 abut against closure walls 40. In such position, elongated board capturing slots 54 and 82 at the opposite side of box 10 are also in alignment in a common plane.

Figure 30:
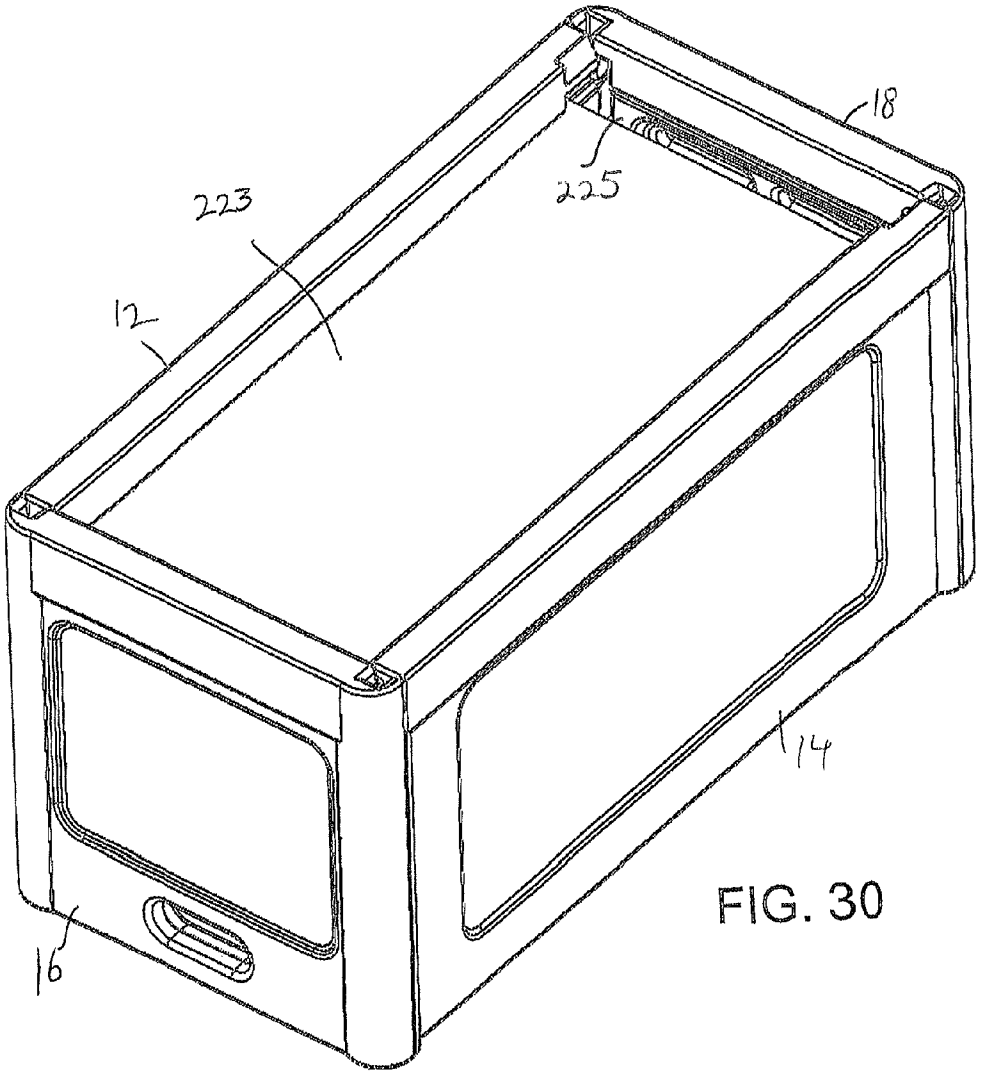
FIG. 30 is a perspective view of the assembly of FIG. 29 rotated so the bottom is facing up in the modified embodiment.
Figure 31:
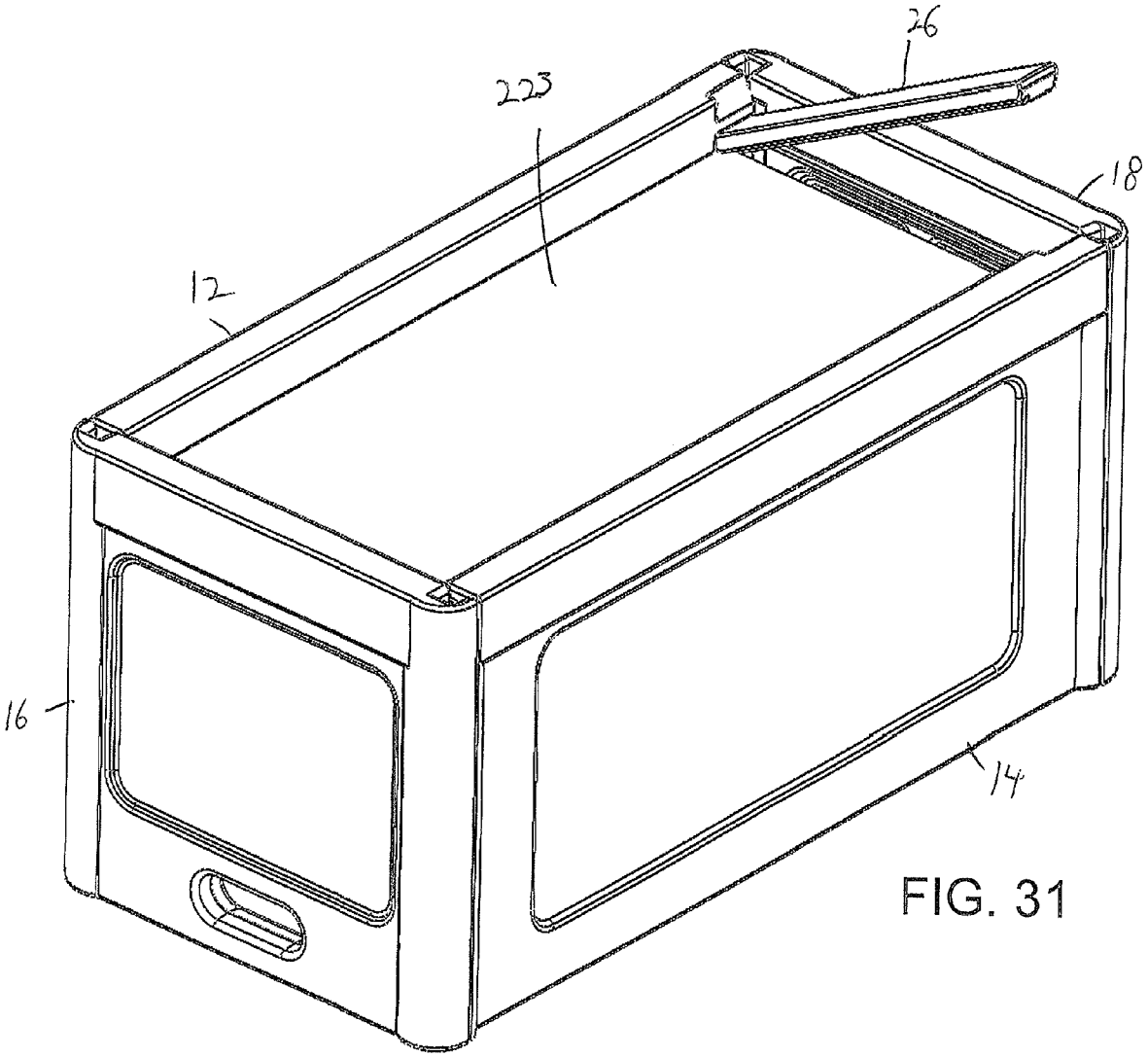
FIG. 31 is a perspective view of the assembly of FIG. 30 rotated so the bottom is facing up and showing a fourth assembly step of the closure rod.
Figure 32:
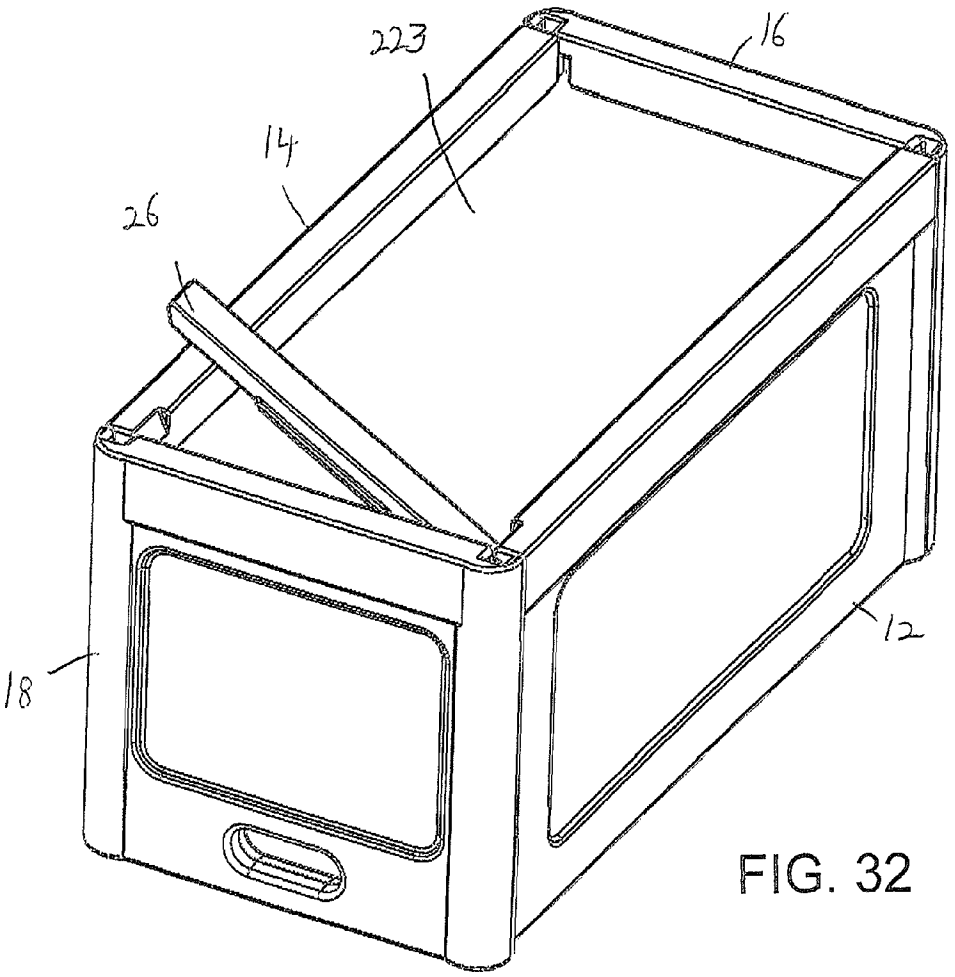
FIG. 32 is a perspective view similar to FIG. 31 but rotated 180 degrees.
Figure 33:
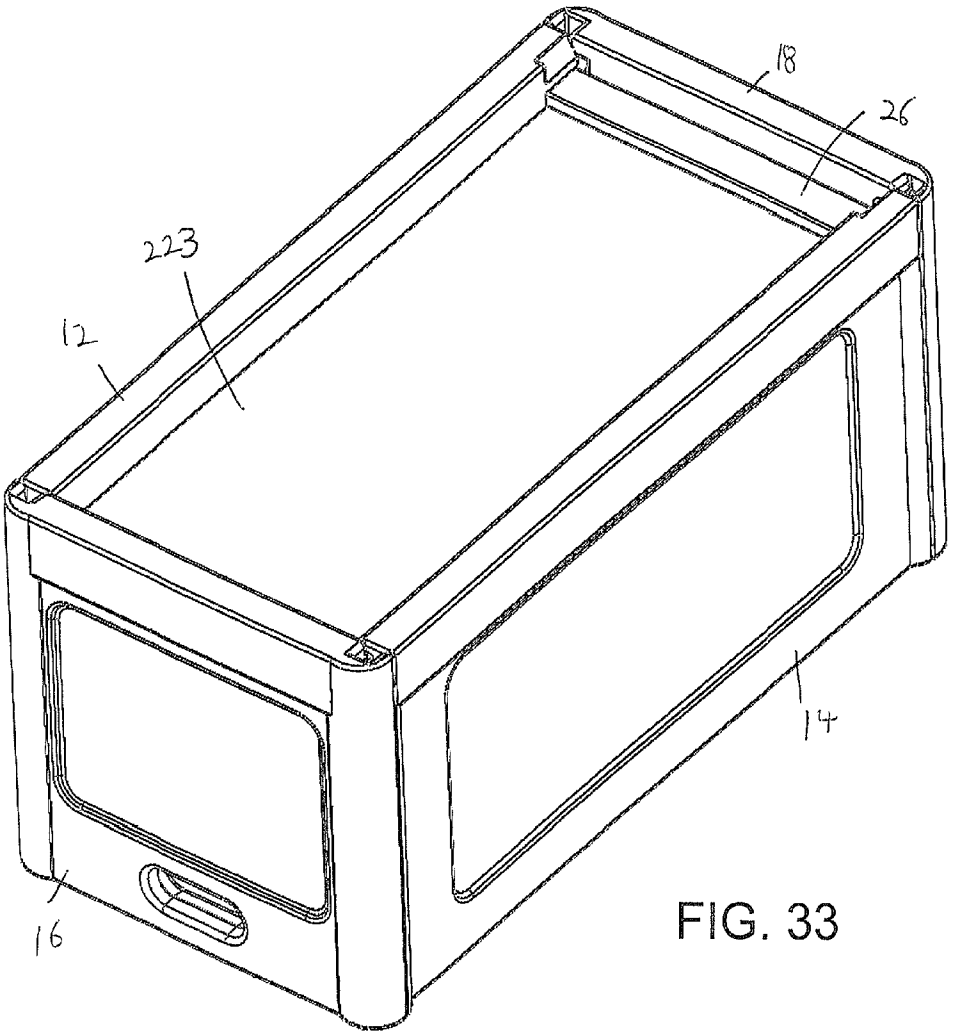
FIG. 33 is a perspective view similar to FIG. 31, with the closure rod fully inserted.

As shown in FIG. 30, in a fourth assembly step, the assembly of FIG. 29 is rotated so that the bottom is facing up. Then, as shown in FIGS. 31-33, insertion bar 100 of closure rod 26 is force fit in the space 225 between single bottom board 223 and end wall 18. For this purpose as shown in FIGS. 31 and 32, one end of closure rod 26 is inserted into one rod capturing recess 84, and the opposite end of closure rod 26 rides up ramp surface 90 at the opposite side of toy box 210, and is then force fit over land 88 until it snaps into place into the other rod capturing recess 84, thereby locking closure rod 24 is place and thereby locking single bottom board 223 in position, with an upper surface 98 of closure rod 26 on one side of insertion bar 100, lying flush against the lower surface of single bottom board 223.

Figure 34:
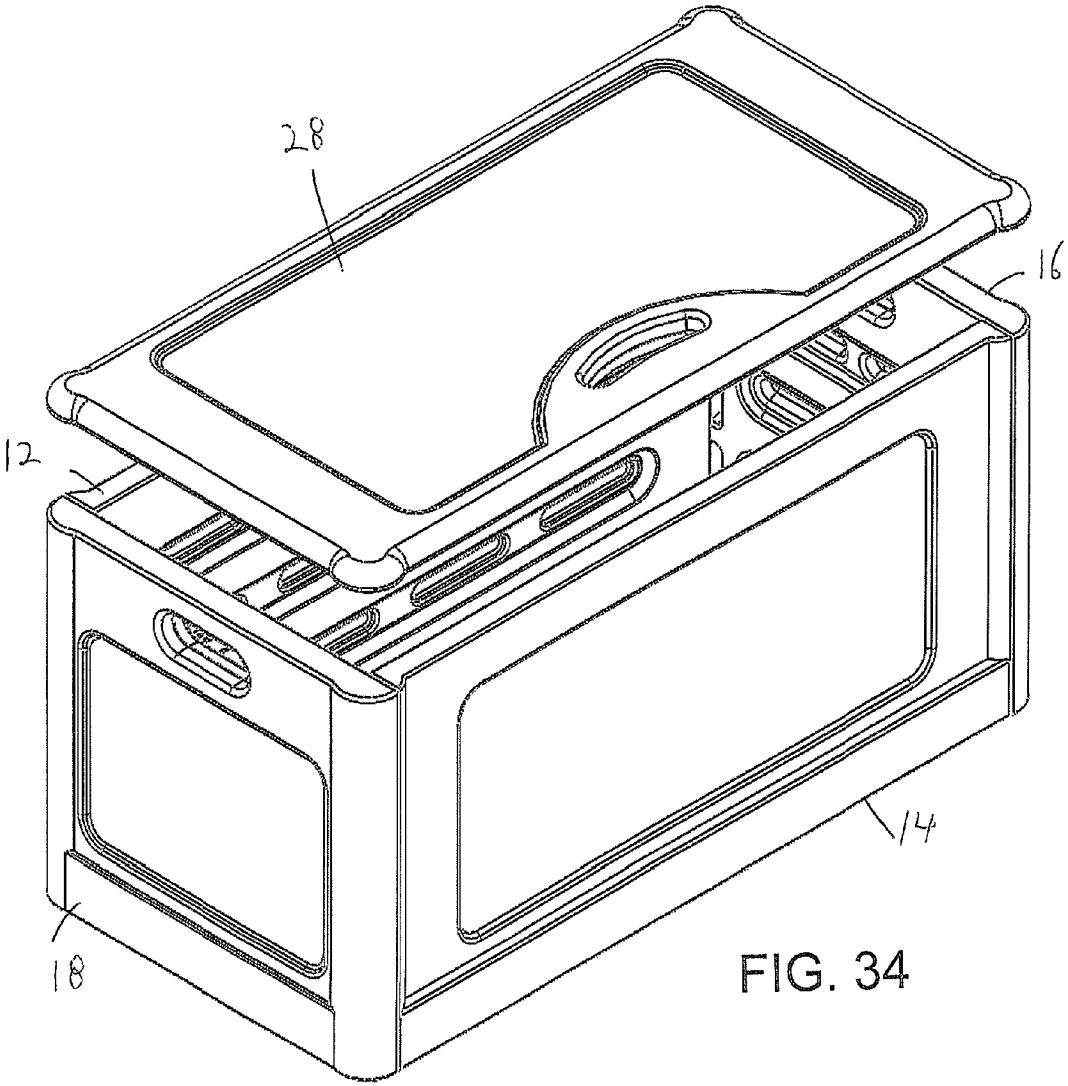
FIG. 34 is a perspective view of the assembly of FIG. 33, rotated back so that the bottom is facing down, and showing a fifth assembly step of inserting the cover thereon.
Figure 35:
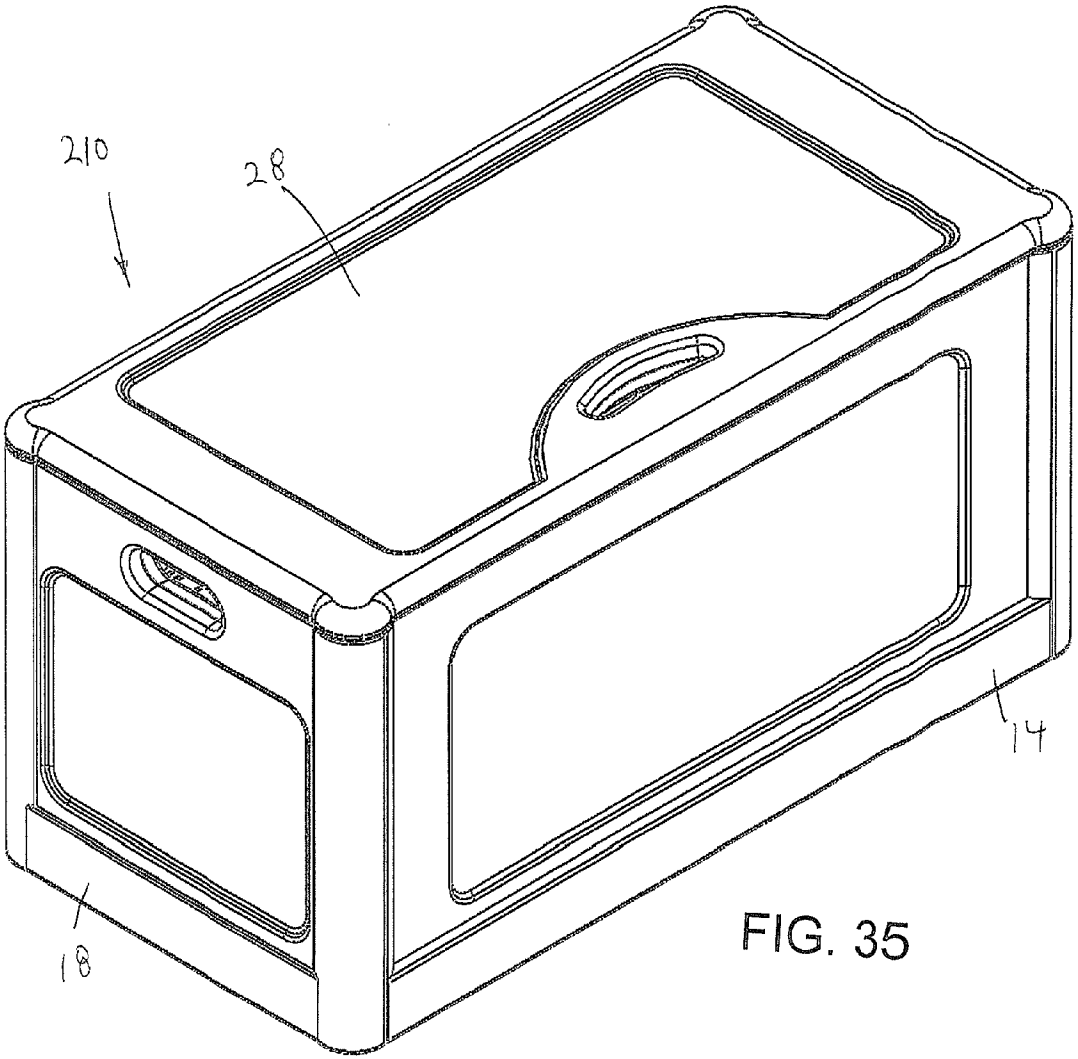
FIG. 35 is a perspective view of the assembly of FIG. 34, showing completion a fifth assembly step of inserting the cover thereon.

Thereafter, as shown in FIGS. 34 and 35, the assembly of FIG. 33 is rotated back so that the bottom is facing down. In a fifth assembly step, removable cover 28 is then inserted in covering relation to the upper open end so that raised portion 108 sits within the upper ends of side walls 12, 14 and end walls 16, 18, and shoulder 112 rests on top of side walls 12, 14 and end walls 16, 18.

It will be appreciated that, although the present invention has been referenced in relation to a toy box, the present invention is not limited thereto, and can be used as a box for any purpose.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A box comprising:

first and second spaced apart side walls;

first and second ends walls connected to opposite ends of said side walls;

each of said side walls having an elongated slot at a lower end of an inner surface thereof;

said first end wall having an elongated slot at a lower end of an inner surface thereof, with said elongated slots of said side walls and said first end wall being coplanar with each other;

at least one flooring member slidably inserted in said elongated slots of said side walls to form a bottom wall of said box; and a removable closure rod discrete from said side walls, said end walls and said at least one flooring member in such a manner that the removable closure rod does not form part of any of said side walls, said end walls and said at least one flooring member prior to assembly of the box, said removable closure rod having a portion inserted into a space in contact with a side edge of said at least one flooring member within a confined space defined by said side walls and said end walls so that the portion of the closure rod extends adjacent the side edge of the at least one flooring member with one of the following arrangements:

the portion of the closure rod is positioned in a force fit manner between side edges of first and second flooring members of said at least one flooring member after the end walls and side walls are connected to each other and after the bottom wall is connected with the first and second side walls such that the first and second flooring members are positioned on directly opposite sides of the closure rod, to lock said at least one flooring member in said elongated slot of said first end wall, and the portion of the closure rod is positioned in a force fit manner between the side edge of said at least one flooring member and a side of said second end wall after the end walls and side walls are connected to each other and after the bottom wall is connected with the first and second side walls such that the at least one flooring member and the second end wall are positioned on directly opposite sides of the closure rod, to lock said at least one flooring member in said elongated slot of said first end wall.

2. A box according to claim 1, wherein each of said end walls has an elongated slot at a lower end of an inner surface thereof, with said elongated slots of said side walls and said end walls being coplanar with each other, and wherein said at least one flooring member is locked in said elongated slots of said side walls and said end walls when said closure rod is inserted into the space adjacent said at least one flooring member.

3. A box according to claim 1, wherein said first and second flooring members are each inserted in said elongated slots of said side walls to form the bottom wall of said box.

4. A box according to claim 1, wherein said at least one flooring member includes a single flooring member, and said closure rod is inserted between an end of said single flooring member and said second end wall.

5. A box according to claim 1, wherein said first and second side walls are in parallel, spaced apart relation to each other and said first and second end walls are in parallel, spaced apart relation to each other.

6. A box according to claim 1, wherein each said end wall has a vertically oriented narrow recess at opposite sides thereof, with one end of each recess being open, and each said side wall has a connecting plate at opposite sides thereof, with each connecting plate removably locking within one said narrow recess.

7. A box according to claim 6, wherein each said narrow recess includes at least one side wall securing rib, and each connecting plate is L-shaped and engages with said at least one side wall securing rib to releasably lock each side wall to a respective said end wall.

8. A box according to claim 6, wherein each of said end walls has an elongated slot at a lower end of an inner surface thereof, with said elongated slots of said side walls and said end walls being coplanar with each other, said elongated slots of said end walls open at opposite ends thereof into said narrow recesses at opposite sides thereof.

9. A box according to claim 6, wherein said elongated slots of said side walls open at opposite ends thereof into said connecting plates at opposite sides thereof.

10. A box according to claim 1, further including hand openings in at least one of:

upper ends of said end walls, and upper ends of said side walls.

11. A box according to claim 1, wherein each said side wall has a capturing recess for holding one end of said closure rod in a position adjacent said at least one flooring member.

12. A box according to claim 11, wherein at least one side wall has a ramp positioned below the respective said capturing recess for aiding in inserting a respective said end of said closure rod in the respective said capturing recess.

13. A box according to claim 12, wherein said closure rod includes a first section that lies against an underside of the at least one flooring member.

14. A method of assembling a box, comprising the steps of:

a first step of assembling a first end of a first side wall having an elongated slot at a lower end of an inner surface thereof, with a first end of a first end wall having an elongated slot at a lower end of an inner surface thereof;

a second step of assembling a first end of a second side wall having an elongated slot at a lower end of an inner surface thereof, with a second end of the first end wall such that the first and second side walls are in spaced apart relation and such that said elongated slots of said side walls and said first end wall are coplanar with each other;

a third step of sliding at least one flooring member into the elongated slots of the first and second side walls from second, opposite ends of the first and second side walls;

a fourth step of assembling the second end of the first side wall with a first end of a second end wall;

a fifth step of assembling the second end of the second side wall with a second end of the second end wall; and a sixth step of inserting a portion of a removable closure rod which is discrete from said side walls, said end walls and said at least one flooring member in such a manner that the removable closure rod does not form part of any of said side walls, said end walls and said at least one flooring member prior to assembly of the box, into a space in contact with a side edge of said at least one flooring member and within a confined space defined by said side walls and said end walls so that the portion of the closure rod extends adjacent the side edge of the at least one flooring member with one of the following arrangements:

force fitting the portion of the closure rod between side edges of first and second flooring members of said at least one flooring member after completion of the first through fifth steps such that the first and second flooring members are positioned on directly opposite sides of the closure rod, to lock said at least one flooring member in said elongated slot of said first end wall, and force fitting the portion of the closure rod between the side edge of said at least one flooring member and a side of said second end wall after completion of the first through fifth steps such that the at least one flooring member and the second end wall are positioned on directly opposite sides of the closure rod, to lock said at least one flooring member in said elongated slot of said first end wall.

15. A method according to claim 14, wherein each of said end walls has an elongated slot at a lower end of an inner surface thereof, with said elongated slots of said side walls and said end walls being coplanar with each other, and further comprising the step of locking said at least one flooring member in said elongated slots of said side walls and said end walls when said closure rod is inserted into the space adjacent said at least one flooring member.

16. A method according to claim 14, wherein said first and second flooring members are each inserted in said elongated slots of said side walls to form the bottom wall of said box.

17. A method according to claim 14, wherein said at least one flooring member includes a single flooring member, and said sixth step includes the step of inserting said closure rod between an end of said single flooring member and said second end wall.

18. A method according to claim 14, wherein said first through fourth assembling steps results in said first and second side walls being in parallel, spaced apart relation to each other and said first and second end walls being in parallel, spaced apart relation to each other.

19. A method according to claim 14, wherein each said end wall has a vertically oriented narrow recess at opposite sides thereof, with one end of each recess being open, and each said side wall has a connecting plate at opposite sides thereof, and each of said first through fourth assembling steps includes the step of removably locking each connecting plate within a respective said narrow recess.

20. A method according to claim 19, wherein each said narrow recess includes at least one side wall securing rib, and each connecting plate is L-shaped, and said step of removably locking includes the step of engaging each L-shaped connecting plate with a respective said side wall securing rib to releasably lock each side wall to a respective said end wall.

21. A method according to claim 19, wherein each of said end walls has an elongated slot at a lower end of an inner surface thereof, with said elongated slots of said side walls and said end walls being coplanar with each other, and said elongated slots of said end walls open at opposite ends thereof into said narrow recesses at opposite sides thereof, and wherein said at least one flooring member also extends outwardly of said elongated slots into said narrow recesses.

22. A method according to claim 19, wherein said elongated slots of said side walls open at opposite ends thereof into said connecting plates at opposite sides thereof.

23. A method according to claim 14, wherein each said side wall has a capturing recess, and wherein said sixth step of inserting a closure rod includes the step of inserting opposite ends of said closure rod into said capturing recesses for holding said closure rod in a position between said at least one flooring member.

24. A method according to claim 23, wherein at least one side wall has a ramp positioned below a respective said capturing recess, and said sixth step of inserting a closure rod includes the step of sliding one end of the closure rod up the ramp for aiding in inserting the respective said end of said closure rod in the respective said capturing recess.

25. A method according to claim 23, wherein said sixth step of inserting a closure rod includes the step of inserting the closure rod so that a first section thereof lies against an underside of the at least one flooring member.

* * * * *